2/5/85 XR 4,497,573

United States Patent [19]

Tokuhara et al.

[11] Patent Number: 4,497,573

[45] Date of Patent: Feb. 5, 1985

[54] VARIABLE MAGNIFICATION OPTICAL APPARATUS

[75] Inventors: Mitsuhiro Tokuhara, Chigasaki; Akiyoshi Torigai, Machida; Teruo Morikawa, Sagamihara, all of Japan

[73] Assignee: Canon Kabushiki Kaisha, Tokyo, Japan

[21] Appl. No.: 411,992

[22] Filed: Aug. 26, 1982

[30] Foreign Application Priority Data

| | | | |
|---|---|---|---|
| Sep. 3, 1981 | [JP] | Japan | 56-139160 |
| Sep. 3, 1981 | [JP] | Japan | 56-139161 |
| Sep. 3, 1981 | [JP] | Japan | 56-139162 |

[51] Int. Cl.[3] ..... G03B 27/36

[52] U.S. Cl. ..... 355/58; 350/423

[58] Field of Search ..... 355/55, 56, 57, 58, 355/8, 11, 65, 66; 354/195; 350/423

[56] References Cited

U.S. PATENT DOCUMENTS

| | | | |
|---|---|---|---|
| 3,259,009 | 7/1966 | Walter | 88/24 |
| 3,416,860 | 12/1968 | Mihojevich et al. | 355/10 |
| 3,431,053 | 3/1969 | Wick et al. | 355/66 |
| 4,077,715 | 3/1978 | Greene | 355/58 |
| 4,155,641 | 5/1979 | Sagara et al. | 355/8 |
| 4,264,198 | 4/1981 | Miyamoto | 355/57 |

*Primary Examiner*—John Gonzales
*Assistant Examiner*—Brian W. Brown
*Attorney, Agent, or Firm*—Fitzpatrick, Cella, Harper & Scinto

[57] ABSTRACT

A variable magnification optical apparatus in which an image of an original can be formed on a photosensitive surface at selectively different magnifications. The amount of movement of a lens for changing the imaging magnification is corrected in accordance with the difference between the actual value and the nominal value of the focal length of the lens, namely, the error of the focal length of the lens.

37 Claims, 14 Drawing Figures

VARIABLE MAGNIFICATION OPTICAL APPARATUS

BACKGROUND OF THE INVENTION

1. Field of the Invention

This invention relates to a variable magnification optical apparatus such as a variable magnification copying apparatus in which an image of an original can be formed on a photosensitive surface at selectively different magnifications.

2. Description of the Prior Art

In the above-described optical apparatus, when the imaging magnification is to be changed, the ratio of the length of the optical path between an original and a lens to the length of the optical path between the lens and a photosensitive surface is changed correspondingly to a selected magnification. It is usually the case that the position of the lens is changed correspondingly to the selected magnification to change the ratio of the lengths of the optical paths.

Now, it is usually the case with the actual lens that due to various factors during the manufacture thereof, the focal length thereof differs from the design value (nominal focal length). That is, the focal length of the actual lens includes an error relative to the design value. (The difference between the design value and the actual focal length will hereinafter be referred to as the error $\Delta f$ of the focal length ) Accordingly, the position of the lens and the length of optical path during one-to-one magnification image formation are corrected correspondingly to the error of the focal length of the lens so that a focused one-to-one magnification image may be formed on the photosensitive surface, but if the lens is subsequently moved over a distance as per the design value to form a reduced image or an enlarged image, the image on the photosensitive surface will be out of focus due to the error of the focal length.

As known literatures, there are U.S. Pat. Nos. 3,259,009; 3,416,860; 3,431,053 and 4,155,641. Any of these patents discloses a device for adjusting the position of the lens or the mirror, but none of them suggests the technique of changing the imaging magnification. Thus, these known literatures merely disclose the technique of focusing an image in an optical apparatus for forming only an image of one magnification. U.S. Pat. No. 4,077,715 discloses a technique whereby, in a variable magnification optical apparatus, the amount of movement of the mirror during original image magnification change is corrected correspondingly to the error of the focal length of the lens. However, in the apparatus of this U.S. Pat. No. 4,077,715, by said correction of the amount of movement of the mirror, the length of the optical path between the original and the lens is corrected correspondingly to the error of the focal length of the lens, but the length of the optical path between the lens and the photosensitive surface is not corrected and therefore, it is impossible to more accurately focus the image of the original formed on the photosensitive surface and it is also difficult to make the magnification of the image of the original more approximate to the target magnification.

SUMMARY OF THE INVENTION

It is an object of the present invention to overcome the above-noted disadvantages peculiar to the variable magnification image formation apparatus of the prior art.

It is another object of the present invention to provide a variable magnification optical apparatus which can form an exactly focused image of an original in any magnification image formation mode even if there is an error in the focal length of the lens.

It is still another object of the present invention to provide a variable magnification optical apparatus which can make the actual imaging magnification of the image of an original approximate as much as possible to the target magnification in any magnification image formation mode even if there is an error in the focal length of the lens.

Other objects and features of the present invention will become apparent from the following detailed description thereof taken in conjunction with the accompanying drawings.

DESCRIPTION OF THE PREFERRED EMBODIMENTS

Figure 1:
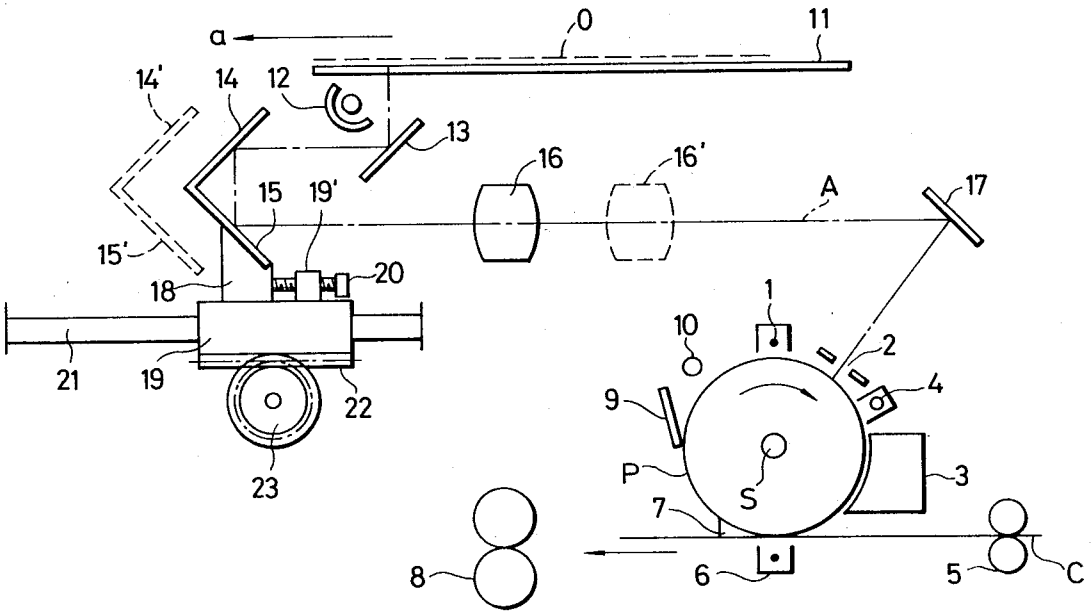
FIG. 1 is a view for illustrating an example of the electrophotographic copying apparatus which is an embodiment of the present invention.

Referring to FIG. 1, a drum-shaped electrophotographic photosensitive medium P is rotated in the direction of arrow about its shaft S. With the rotation thereof, the photosensitive medium P is uniformly charged over the entire surface thereof by a corona discharger 1, and then by an optical system of variable imaging magnification to be described, an optical image of an original O is projected onto the photosensitive medium P through a slit 2. By this slit exposure of the optical image, an electrostatic latent image is formed on the photosensitive medium P, and then is developed by a developing device 3. Thus, a toner image corresponding to the image of the original O is obtained on the photosensitive medium P. Transfer paper C is fed to an image transfer station by conveyor rollers 5. In the image transfer station, the paper C is brought into contact with the photosensitive medium P and is subjected to the action of a corona discharger 6, whereby the toner image of the original is transferred to the paper C. After having passed through the image transfer station, the paper C is directed to a fixing device 8 for fixation of the transferred image on the paper C. On the other hand, any toner remaining on the surface of the photosensitive medium after the image transfer is removed therefrom by a cleaning member 9, whereafter the whole surface of the photosensitive medium is illuminated by a lamp 10 to remove any residual charge therefrom. Thereafter, the above-described image formation process cycle is repeated again.

Now, reference numeral 11 designates a movable original carriage on which the original O to be copied is supported. The original O supported on the carriage 11 is illuminated by a lamp 12. The light from the original O is reflected by mirrors 13, 14 and 15 in the named order, enters an imaging lens 16, exits from the lens 16, and thereafter is reflected by a mirror 17 and passed through the slit 2 to the photosensitive medium P. The lamp 12 and mirrors 13, 17 are always fixed at predetermined positions, and the mirrors 14, 15 and lens 16 are moved during magnification changing operation but remain stationary at their positions corresponding to a selected image magnification when the photosensitive medium P is being exposed to the optical image of the original. When the photosensitive medium P is to be slit-exposed to the optical image of the original as described above, the original carriage 11 is moved in the direction of arrow a, whereby the original is scanned. The movement speed of the carriage 11 in the direction of arrow a, or in other words, the scanning speed of the original O, is changed correspondingly to the selected image magnification. Alternatively, the movement speed of the carriage 11 may be the same for any image magnifications and the peripheral speed of the photosensitive medium may be changed correspondingly to the selected image magnification, or both the movement speed of the carriage 11 and the peripheral speed of the photosensitive medium P may be changed correspondingly to the selected image magnification. In any case, if the movement speed of the carriage 11 is $v_1$ and the peripheral speed of the photosensitive medium P is $v_2$, the correlation between $v_1$ and $v_2$ is changed so that a relation that $v_2/v_1=m$ (m is the selected image magnification) is established. When the original scanning is terminated, the carriage 11 is moved backward at a higher speed in the direction opposite to the direction of arrow a and returns to its forward movement starting position. (It is to be understood that the term "selected image magnification" used herein refers to the target value of the magnification of the formed image and that m magnification ($m=1$ or $m>1$ or $0<m<1$) copy mode refers to a copy mode in which the target value of the magnification of the formed image is m.)

Now, the lens 16 for forming the optical image of the original O on the photosensitive medium P is held at its solid line position during one-to-one magnification copy mode and is held at its broken line position 16' during $\beta$ magnification (the case of $\beta<1$ is exemplified) copy mode. That is, the lens 16 is moved by magnification changing operation in order to change the ratio of the length of the optical path between the original and the lens to the length of the optical path between the lens and the photosensitive medium correspondingly to the selected image magnification. On the other hand, the mirrors 14 and 15 disposed in orthogonal relationship with each other and directing the light from the original O to the lens are held at their solid line positions during one-to-one magnification copy mode, and are held at their broken line positions 14' and 15' during $\beta$ magnification copy mode. That is, the mirrors 14 and 15 are moved by magnification changing operation in order to change the length of the optical path between the original and the photosensitive medium correspondingly to the selected image magnification.

The mirrors 14 and 15 are fixed to a first mirror bed 18. The first mirror bed 18 in turn is fixed to a second mirror bed (mirror carriage) 19. However, the fixed position of the first mirror bed 18 relative to the second mirror bed 19 is adjustable in a direction parallel to the optical axis A of the lens by a screw 20 threadably engaged with the projected portion 19' of the bed 19 and the bed 18. That is, during the assembly or repair of the copying apparatus, the screw 20 is rotatively adjusted to move and adjust the mirrors 14 and 15 in parallel to the optical axis A, thereby locating the mirrors 14 and 15 at their positions corresponding to the amount of error of the focal length of the lens 16. More particularly, if there is an amount of error $\Delta f$ from the design value f in the focal length of the lens 16, the mirrors 14 and 15 are located so that the length of the optical path between the original O and the photosensitive medium P is equal to the length of the optical path between the original and the photosensitive medium when there is not the above-mentioned error in the focal length of the lens 16, plus a length corresponding to $\Delta f$. After such adjustment of the screw 20, the relative fixed positional relation between the first and second mirror beds 18 and 19 is maintained constant until the screw 20 is again adjusted from the requirement of repair or the like. The correction of the length of the optical path between the original and the photosensitive medium by the correction of the positions of the mirrors 14 and 15 effected by the use of the screw 20 is not requisite, but it is effective at least when it is desired that exactly one-to-one magnification image or exactly $\beta$ magnification image of the original be formed on the photosensitive medium in focused condition. As described above, where the focal length of the lens is $(f+\Delta f)$, if the length of the optical path between the original and the photosensitive medium is corrected to the length of the optical path between the original and the photosensitive medium when the focal length of the lens is f, plus $(4\times\Delta f)$, exactly one-to-one magnification image of the original can be formed on the photosensitive medium in focused condition. On the other hand, where the focal length of the lens is $(f+\Delta f)$, if the length of the optical path between the original and the photosensitive medium is corrected to the length of the optical path between the original and the photosensitive medium when the focal length of the lens is f, plus $$\frac{(1+\beta)^2}{\beta}\Delta f,$$

exactly $\beta$ magnification image of the original can be formed on the photosensitive medium is focused condition during $\beta$ magnification copy mode. For simplicity of description, in the example of the positional adjustment of the mirrors 14 and 15 by the screw 20, description will hereinafter be made of a case where the former correction is made. However, the present invention is also applicable to an example in which the latter correction is made. When $\Delta f$ is not zero and where it is only required that an image of a magnification approximate to one-to-one magnification be formed during one-to-one magnification image formation mode or an image of a magnification approximate to $\beta$ magnification be formed during $\beta$ magnification image formation mode, the above-described positional adjustment of the mirrors 14 and 15 by the screw 20 is unnecessary.

The second mirror bed 19 is supported on a guide rail 21 for movement in a direction parallel to the optical axis A of the lens. A rack 22 is secured to the second mirror bed 19 and a pinion 23 is in mesh engagement with the rack 22. Thus, during magnification changing operation, the pinion 23 is rotatively driven, whereby the bed 19 on which the mirrors 14 and 15 are fixedly supported is guided and moved along the rail 21. By this, the mirrors 14 and 15 are moved from their solid line positions to their broken line positions or from their broken line positions to their solid line positions, thereby changing the length of the optical path between the original and the photosensitive medium to a length of optical path corresponding to the selected image magnification. In other words, by the pinion 23 being rotatively driven, the mirrors 14 and 15 are moved in a direction parallel to the optical axis A of the lens by a distance $(1-\beta)^2f/2\beta$, whereby the length of the optical path between the original and the photosensitive medium is changed by $(1-\beta)^2f/\beta$. In the present embodiment, the amount of movement of the mirrors 14 and 15 or the bed 19 during magnification changing operation is constant irrespective of the error of the focal length of the lens. That is, if an apparatus having mirror position correcting means such as the screw 20 is taken as an example, the mirrors 14 and 15 are located, during one-to-one magnification image formation mode (one-to-one magnification copy mode), at such positions that the length of the optical path between the original and the photosensitive medium is $4\times(f+\Delta f)$ and, during $\beta$ magnification image formation mode ($\beta$ magnification copy mode), at such positions that the length of the optical path between the original and the photosensitive medium is $\{4(f+\Delta f)+(1-\beta)^2f/\beta\}$. ($\Delta f=0$ when there is no error in the focal length of the lens.)

The amount of movement of the lens 16 along the optical axis A thereof during magnification changing operation, is $(1-\beta)f$ when there is no error in the focal length of the lens 16. That is, when there is no error in the focal length of the lens 16, both the length of the optical path between the original and the lens and the length of the optical path between the lens and the photosensitive medium are 2f during one-to-one magnification image formation mode, and by the movement of the mirrors 14, 15 and the lens 16, the length of the optical path between the original and the lens and the length of the optical path between the lens and the photosensitive medium are $(1+\beta)f/\beta$ and $(1+\beta)f$, respectively, during $\beta$ magnification image formation mode. However, when there is in the focal length of the lens 16 an error $\Delta f$ which is not 0, a focused image cannot be obtained on the photosensitive medium simply by moving the lens 16 over the aforementioned distance $(1-\beta)f$ by magnification changing operation. Therefore, according to the present invention, the amount of movement of the lens along the optical axis A during magnification changing operation is corrected correspondingly to the error $\Delta f$ of the focal length of the lens. By this, the length of the optical path between the original and the lens and the length of the optical path between the lens and the photosensitive medium are both corrected correspondingly to $\Delta f$, whereby a very exactly focused image can be obtained during both one-to-one magnification image formation mode and $\beta$ magnification image formation mode.

More particularly, by magnification changing operation, the lens is moved along the optical axis A substantially over a distance $$(1-\beta)f+\frac{(\beta^2-1)f+\sqrt{\{(1+\beta)^2f+4\beta\Delta f\}(1-\beta)^2f}}{2\beta}$$

Accordingly, when the error $\Delta f$ of the focal length of the lens is not 0, both the length of the optical path between the original and the lens and the length of the optical path between the lens and the photosensitive medium are $2(f+\Delta f)$ during one-to-one magnification image formation mode and, by said movement of the mirrors 14, 15 and the movement of the lens 16 over said distance corresponding to $\Delta f$, the length of the optical path between the original and the lens and the length of the optical path between the lens and the photosensitive medium are P and Q, respectively, during $\beta$ magnification image formation mode. P and Q can be expressed as follows:

$$P=\frac{(1+\beta)^2f+4\beta\Delta f+\sqrt{\{(1+\beta)^2f+4\beta\Delta f\}(1-\beta)^2f}}{2\beta}$$

$$Q=\frac{(1+\beta)^2f+4\beta\Delta f-\sqrt{\{(1+\beta)^2f+4\beta\Delta f\}(1-\beta)^2f}}{2\beta}$$

Thus, during $\beta$ magnification image formation mode, an image Q/P times the original is actually formed on the photosensitive medium, and $\beta$ differs from Q/P, but this amount of difference generally is very small and practically negligible.

Figure 2:
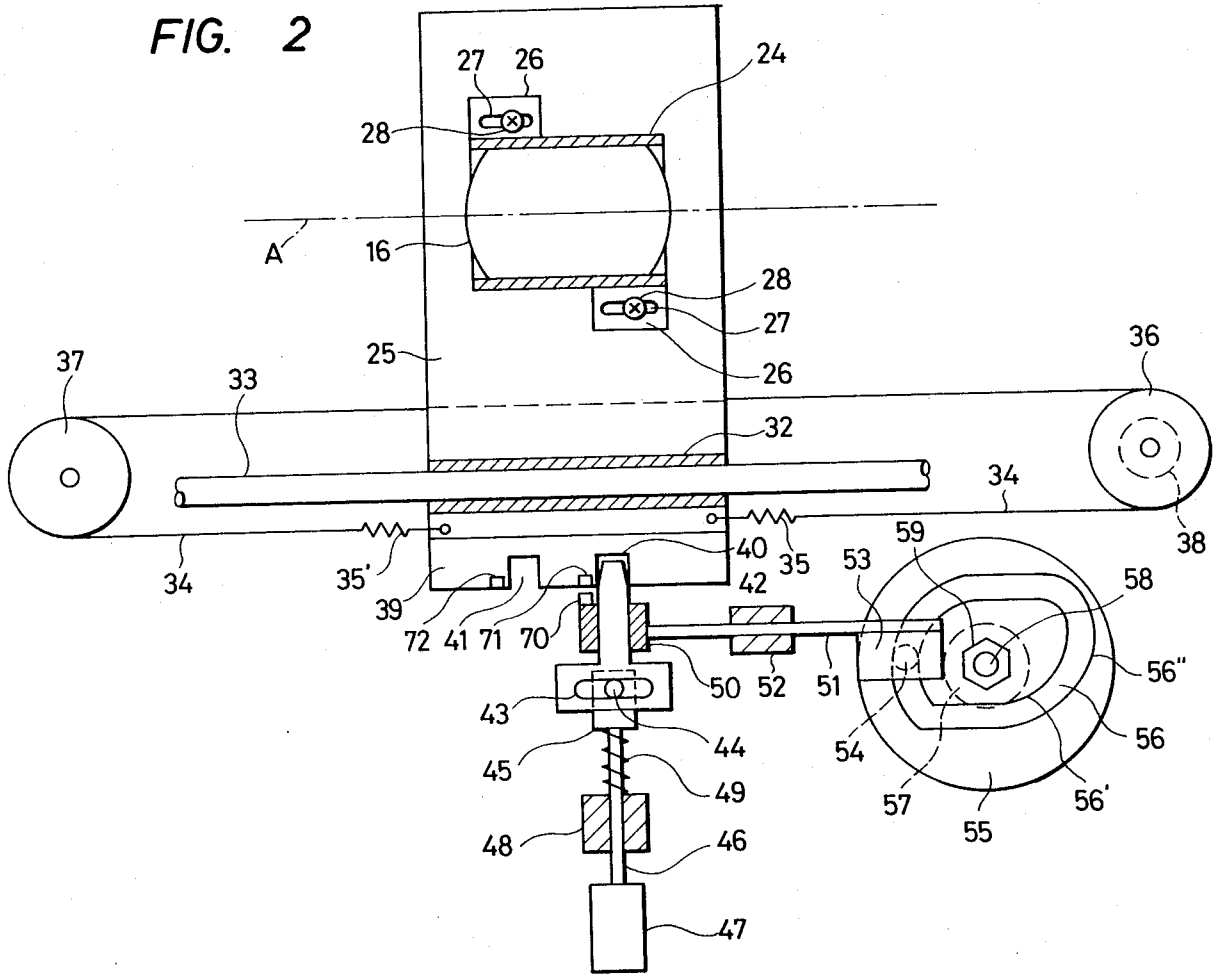
FIG. 2 is a view for illustrating an embodiment of the present invention.

Reference is now had to FIG. 2 to describe an example of the lens moving mechanism. FIG. 2 is a plan view, partly in cross-section, of the lens moving mechanism. The lens 16 is fixedly held in a lens barrel 24. The lens barrel 24 is fixed to a lens bed (lens carriage) 25. The lens barrel 24 has a mounting plate 26 which has an elongated slot 27 in a direction parallel to the optical axis A of the lens, namely, a direction parallel to the direction of movement of the lens during magnification changing operation. A screw 28 is fitted in the slot 27 and threaded into the lens bed 25, whereby the lens barrel 24 and accordingly the lens 16 is fixed to the lens bed 25.

A slide bearing 32 is fixed to the lens bed 25 and is movably fitted on a guide shaft 33 fixed to an immovable member such as a beam within the copying apparatus body. The guide shaft 33 extends parallel to the optical axis A. Under the guidance of the shaft 33, the lens bed 25 and accordingly the lens 16 is movable along the optical axis A, as previously described. Wire 34 is connected to the lens bed 25 through wire slack preventing springs 35 and 35'. The springs 35 and 35' are connected to the wire 34 and the lens bed 25 in their tensioned conditions. The wire 34 is passed over pulleys 36 and 37. The pulley 36 is connected to the output shaft of a reversible motor 38. When the mode is to be changed from one-to-one magnification image formation mode to $\beta$ magnification image formation mode, if the motor 38 is rotated in forward direction, the pulley 36 is rotated counter-clockwisely and the lens bed 25 is moved parallel to the optical axis A rightwardly as viewed in FIG. 2. When the mode is to be changed from $\beta$ magnification image formation mode to one-to-one magnification image formation mode, if the motor 38 is rotated in reverse direction, the pulley 36 is rotated clockwisely and the lens bed 25 is moved parallel to the optical axis A leftwardly as viewed in FIG. 2.

A positioning plate 39 is fixed to an end of the lens bed 25. Accordingly, the plate 39 is a part of the lens bed 25. The plate 39 is provided with cut-aways 40 and 41. The spacing between these cut-aways 40 and 41 is equal to the previously described amount of movement of the lens during the magnification changing operation when there is no error in the focal length of the lens, i.e., $(1-\beta)f$. Thus, during one-to-one magnification copy mode, a stopper 42 comes into engagement with the cut-away 40 and, during reduction copy mode, a stopper 42 comes into engagement with the cut-away 41, whereby the lens bed 25 and accordingly the lens 16 is held stationarily at a position corresponding to the selected image magnification. In the device of FIG. 2, if the stopper 42 is designed to come into and out of the cut-aways 40 and 41 at the same position, the lens 16 will be moved only over the distance $(1-\beta)f$ with respect to the direction of the optical axis A of the lens. Thus, in such construction, if the lens 16 has a focal length f as per the design value, a focused image of the original will be formed on the photosensitive medium P during both one-to-one magnification copy mode and reduction copy mode. However, if the focal length of the lens 16 has an error $\Delta f$ relative to the design value f and if the image is focused during one-to-one magnification copy mode, the image will be out of focus during reduction copy mode. For this reason, the following contrivance is applied to the device of FIG. 2.

A slot 43 elongated in a direction parallel to the optical axis A (namely, a direction parallel to the direction of movement of the lens) is provided in the base of the stopper 42, and a pin 44 is loosely fitted in this slot 43. The pin 44 is studded in a pin bed 45 fixed to one end of a rod 46. The other end of the rod 46 is connected to an electromagnetic solenoid 47. The rod 46 is supported for movement lengthwise thereof on a slide bearing 48 fixed in place. A compression spring 49 is interposed between the pin bed 45 and the bearing 48. The spring 49 resiliently biases the stopper 42 through the pin 44 of the pin bed 45 so that the stopper 42 comes into engagement with the cut-aways 40 and 41. When electrically energized, the solenoid 47 pulls the rod 46 against the spring force of the spring 49 to retract the stopper 42 from the cut-aways 40 and 41 and bring it to a position for providing free movement of the plate 39.

The stopper 42 is inserted into the stopper receiving hole of a stopper guide member 50 in such a manner that the stopper is movable in a direction perpendicular to the optical axis A. The guide member 50 is fixed to an end of a rod 51 supported for movement in a direction parallel to the optical axis A (a direction parallel to the direction of movement of the lens) on a slide bearing 52 fixedly held in place. When the rod 51 is moved in a direction parallel to the optical axis A, the stopper 42 supported by the guide member 50 is also moved in the same direction. Since the stopper 42 is connected to the pin 44 by the slot 43, the pin 44 does not impede the movement of the stopper 42 in a direction parallel to the optical axis A and the stopper 42 is moved relative to the pin 44 in a direction parallel to the optical axis A.

A pin bed 53 is fixed to the other end of the rod 51 and a pin 54 is studded in the pin bed 53. The pin 54 is fitted in a slot cam 56 formed in a cam plate 55 and bears against both the inner cam surface 56′ and the outer cam surface 56″ of the slot cam 56. The cam plate 55 is fixed to the output shaft 58 of a motor 57 by a nut 59 screwed onto this shaft. If the nut 59 is loosened during assembly or repair of the copying apparatus, the mounting angle or orientation of the cam plate 55 relative to the shaft 58 may be adjusted. That is, if the nut 59 is loosened and the cam plate 55 is rotatively adjusted relative to the shaft 58 and the nut 59 is again tightened with the pin 54 as a cam follower bearing against the desired cam surface portion of the slot cam 56, the cam plate 55 and accordingly the slot cam 56 will be fixed relative to the shaft 58. In any case, if, during magnification changing operation, power is supplied to the motor 57 to rotatively drive the shaft 58 and rotate the cam plate 55, the pin 54 engaged with the slot cam 56 will be moved in a direction parallel to the optical axis A correspondingly to the shape of the slot cam 56, whereby the stopper 42 will be moved in the same direction as the pin 54 and by the same amount as the amount of movement of the pin 54. In the embodiment of FIG. 2, two magnifications can be selected and therefore, during magnification changing operation, the cam plate 55 is rotatively driven, for example, through (360/2) degrees, namely, 180 degrees.

Figure 3:
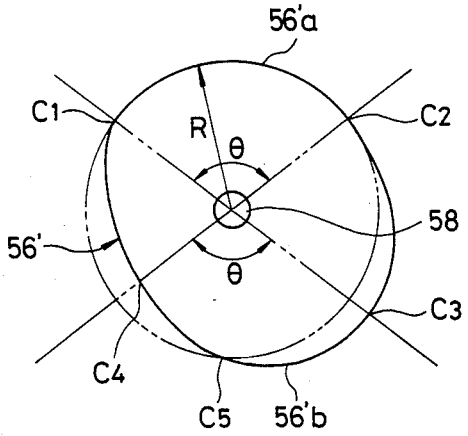
FIG. 3 illustrates a cam for correcting the amount of movement of the lens.

FIG. 3 shows the configuration of the inner cam surface 56′ of the slot cam 56. The configuration of the other cam surface 56″ is similar to that of the inner cam surface 56′. The area 56′*a* extending from a point $C_1$ on the cam surface 56′ clockwisely to a point $C_2$ is an arcuate area of radius R centered at a shaft 58, and during one-to-one magnification copy mode, the pin 54 bears against a portion of this area 56′*a*. During reduction copy mode, the pin 54 bears against a portion of the area 56′*b* extending from a point $C_3$ on the cam surface 56′ clockwisely to a point $C_4$ which corresponds to the error $\Delta f$ of the focal length of the lens. The distance between the shaft 58 and the point $C_3$ is greater than the radius R of the area 56′*a*, the distance between the shaft 58 and the point $C_4$ is smaller than the radius R, and the distance from the shaft 58 becomes gradually decreased as it progresses clockwisely from the point $C_3$ to the point $C_4$. At a point $C_5$, the distance from the shaft 58 is equal to the radius R of the area 56′*a*. The angle $\theta$ at which the area 56′*a* subtends the shaft 58 is equal to the angle $\theta$ at which the area 56′*b* subtends the shaft 58, and these two angles are in the relation of opposite angle.

Description will now be made of the positional adjustment of the lens during one-to-one magnification image formation mode. The stopper 42 is first drawn out of the cut-aways 40 and 41 of the plate 39 and the lens bed 29 is rendered movable. The nut 59 is then loosened and the cam plate 55 is rotated relative to the shaft 58, and the nut 59 is tightened with the pin 54 bearing against a suitable location in the area 56′*a* of the cam surface, whereby the cam plate 55 is fixed to the shaft 58. In this condition, the position of the stopper 42 during one-to-one magnification image formation mode is set. This position is the same whether or not there is the aforementioned error in the focal length of the lens. The lens bed 25 is moved to a position in which the stopper 42 set in position as described above may be inserted into the cut-away 40, and in this condition, the stopper 42 is inserted into the cut-away 40 to thereby position and fix the lens bed 25. By this, the position of the lens bed 25 during one-to-one magnification image formation mode is set. The screw 28 is then loosened and the lens barrel 24 and accordingly the lens 16 is moved and adjusted in the direction of the optical axis A relative to the lens bed 25 and is brought to a position in which a focused one-to-one magnification image of the original is formed on the photosensitive medium P (a position in which the length of the optical path between the original and the lens is rendered equal to the length of the optical path between the lens and the photosensitive medium), and in this condition, the screw 28 is tightened to fix the lens. The fixed position of the lens on the lens bed 25 with respect to the direction of the optical axis A brought about by said adjustment corresponds to the error Δf of the focal length of the lens 16. The lens position when Δf is not 0 is displaced with respect to the direction of the optical axis A over a distance 2Δf from the lens position at which there is no error of the focal length. The direction of displacement is the direction toward the photosensitive medium when Δf is negative, and is the opposite direction when Δf is positive. (During the adjustment of the lens position in one-to-one magnification copy mode, the positional adjustment of the mirrors 14 and 15 by the screw 20 may also be effected.)

Description will now be made of the lens positioning during $\beta$ magnification image formation mode. After termination of the adjustment of the lens position during one-to-one magnification image formation mode, the stopper 42 is drawn out of the cut-away 40 and the lens bed 25 is moved to a position in which the cut-away 41 engages the stopper 42, whereupon the stopper 42 is inserted into the cut-away 41. Accordingly, the lens 16 is moved in the direction A over the previously described distance $(1-\beta)f$. When there is said error in the focal length of the lens 16, the image of the original formed on the photosensitive medium is out of focus in this condition. Therefore, the nut 59 is again loosened and the cam plate 55 is rotated relative to the shaft 58 with the stopper 42 remaining inserted in the cutaway 41. As is apparent from what has been previously described, the rotation of the cam plate 55 is transmitted through the pin 54 and the rod 51 to the stopper 42, which is thus moved in a direction parallel to the optical axis A under the guidance of the slot 43 with the rotation of the cam plate 55, so that the lens bed 25 is also moved in the same direction. Accordingly, the lens 16 is also moved in a direction along the optical axis A. With the shaft 58 remaining fixed, the cam plate 55 is rotated to a position in which the area **56'*b* of the cam surface 56' bears against the pin 54, and further, the cam plate 55 is rotatively adjusted relative to the shaft 58 within a range in which the pin 54 bears against the area 56'*b*, whereby the position of the lens 16 with respect to the direction of the optical axis is adjusted. When, by this adjustment, the lens 16 has been brought to a position in which a focused reduced image of the original O can be formed on the photosensitive medium P, with respect to the direction of the optical axis, the nut 59 is tightened to fix the cam plate 55 relative to the shaft 58, whereby the position of the stopper 42 for the formation of reduced image is set. That is, the position of the lens bed 25 during $\beta$ magnification image formation mode is set. In this condition, the pin 54 bears against a portion in the area 56'*b* of the cam surface 56' which corresponds to the error Δf of the focal length of the lens. That is, as described above, the cam plate 55 is rotatively adjusted and the position in which the pin 54 bears against the cam surface area 56'*b* is adjusted within the range of this area 56'*b*, whereby when the Δf is not 0, the position of the stopper 42 during $\beta$ magnification image formation mode is changed substantially by a distance ΔL from the position of the stopper 42** during one-to-one magnification image formation mode, with respect to the direction parallel to the optical axis, as will be seen from what has been previously described.

$$\left(\Delta L = \frac{(\beta^2 - 1)f + \sqrt{\{(1+\beta)^2 f + 4\beta\Delta f\}(1-\beta)^2 f}}{2\beta}\right)$$

In other words, by this, the position of the lens 16 during $\beta$ magnification image formation mode when Δf is not 0 is corrected by the distance ΔL with respect to the direction of the optical axis A from the position thereof when there is no error in the focal length of the lens, whereby a focused reduced image of the original (when Δf is 0, an image of exactly $\beta$ magnification and when Δf is not 0, an image of a magnification as approximate as possible to $\beta$ magnification) is obtained on the photosensitive medium P. When Δf is 0, the pin 54 bears against the point $C_5$ in the area **56'*b* of the cam surface 56' during $\beta$ magnification image formation mode. Accordingly, the position of the stopper 54** at this time is the same as that during one-to-one magnification image formation mode.

After the setting of the position in which the pin 54 bears against the slot cam 56 during $\beta$ magnification image formation mode has been terminated in the manner described above, the cam plate 55 is rotated through 180° each during magnification changing operation. Thus, the stopper 42 is moved from the position for one-to-one magnification image formation mode to the position for $\beta$ magnification image formation mode adjusted and set correspondingly to Δf or from the latter position to the former position. As will be seen from what has been previously described, wherever the position of the cam surface against which the pin 54 bears during $\beta$ magnification image formation mode may be adjusted and set, the pin 54 bears against the slot cam 56 in the area **56'*a* during one-to-one magnification image formation mode. That is, irrespective of the magnitude of Δf, the position of the stopper 42** during one-to-one magnification image formation modc is fixed.

Now, in the manner described above, the position of the stopper 42 during $\beta$ magnification image formation mode is corrected by said ΔL corresponding to Δf with respect to the direction parallel to the optical axis A when Δf is not 0. Accordingly, when Δf is not 0, the amount of movement of the lens bed 25, fixedly supporting the lens 16, with respect to the direction along the optical axis A is changed to the amount of movement $(1-\beta)f$ when Δf is 0, plus said ΔL, whereby a focused image of the original is formed on the photosensitive medium during both one-to-one magnification image formation mode and $\beta$ magnification image formation mode.

(During the lens position adjustment for one-to-one magnification image formation mode, the mirrors 14 and 15 are disposed at their solid line positions of FIG. 1 and during the lens position adjustment for $\beta$ magnification image formation mode, the mirrors 14 and 15 are disposed at their broken line positions of FIG. 1.)

In the previously described example, the position of the stopper 42 during $\beta$ magnification image formation mode has been obtained by moving the lens 16 and the stopper 42 at a time with the stopper 42 fitted in the cut-away 41, whereas an adjusting method may also be adopted which comprises rotating the pulley 36 to move the lens bed 25 in a direction parallel to the optical axis A with the stopper 42 being engaged with neither of the cut-aways 40 and 41, thereby bringing the lens 16 to a position in which a focused reduced image of the original can be formed on the photosensitive medium P, thereafter rotating the cam plate 55 relative to the shaft 58 to move the stopper 42 to a position in which it can fit in the cut-away 41, and thereafter fixing the cam plate 55 to the shaft 58. It is also possible to first obtain the stopper position for $\beta$ magnification image formation mode and then obtain the lens position for one-to-one magnification image formation mode.

Now, in FIG. 2, reference numeral 70 designates a magnet fixed to the stopper supporting bed 50. Accordingly, with the rotation of the cam plate 55, the magnet 70 is moved in the same direction and by the same amount as the stopper 42. On the other hand, designated by 71 and 72 are magnetic force detecting elements such as Hall IC for forming signals in response to the magnetic force of the magnet 70 when the magnet becomes opposed to the magnetic force detecting elements. The elements 71 and 72 are fixed to the plate 39 at positions adjacent to the cut-aways 40 and 41, respectively. The element 71 is fixed to the plate 39 so that it becomes opposed to the magnet 70 when the cut-away 40 has come to a position in which it can engage the stopper 42, while the element 72 is fixed to the plate 39 so that it becomes opposed to the magnet 70 when the cut-away 41 has come to a position in which it can engage the stopper 42. Accordingly, the spacing between the element 71 and the cut-away 40 is equal to the spacing between the element 72 and the cut-away 41. The magnet 70 and the elements 71 and 72 together constitute a device for detecting the position of the lens bed 25 and accordingly of the lens 16. At a point of time whereat the elements 71 and 72 have formed the signals, the power supply to the motor 38 and solenoid 47 is stopped to stop the operations thereof. That is, the motor 38 and solenoid 47 are controlled by the signals of the elements 71 and 72.

The operation of the above-described device will hereinafter be described. When the apparatus is in one-to-one magnification image formation mode, the stopper 42 is in engagement with the cut-away 40 and the pin 54 bears against the cam surface 56' in the area **56'*a* of the rotary cam plate 55 and thus, the lens 16 is located at a one-to-one magnification image formation position corresponding to the error of the focal length thereof. Next, when a magnification mode changing switch is closed, power is first supported to the solenoid 47 and by the operation thereof, the stopper 42 is drawn out of the cut-away 40. The motor 38 is then rotated in forward direction to rotatively drive the pulley 36 counterclockwisely and thereby move the lens bed 25 rightwardly along the optical axis A, as viewed in FIG. 2. In synchronism with the initiation of rotation of the motor 38, the motor 57 starts its revolution and rotates the cam plate 55 through 180°. By this, the pin 54 is caused to bear against a position in the area 56'*b* of the cam surface 56' which corresponds to the error $\Delta f$ of the focal length of the lens. In other words, the stopper 42 and the magnet 70 are moved to a position corresponding to the $\Delta f$ during $\beta$ magnification image formation mode. The 180° rotation of the cam plate 55 is completed before the lens 16 reaches the position corresponding to the $\Delta f$ for $\beta$ magnification image formation mode, that is, before the cut-away 41 reaches the position in which it engages the stopper 42. After the 180° rotation of the cam plate 55 is terminated, the lens bed 25 reaches a position in which the cut-away 41 is rendered engageable with the stopper 42 and at this time, the element 72 becomes opposed to the magnet 70 and therefore, the element 72 forms a signal, by which the motor 38 is deenergized to stop movement of the lens bed 25 and at the same time, the solenoid 47 is also deenergized to permit the stopper 42 to come into the cut-away 41 with the aid of the biasing force of the spring 49. By this time, the lens 16 has been moved over said distance $\{(1-\beta)f+\Delta L\}$ and brought to a position corresponding to $\Delta f$ for $\beta$ magnification image formation mode, and is located at this position by the engagement between the stopper 42 and the cut-away 41**.

The mirrors 14 and 15 of FIG. 1 are also moved from their solid line positions to their broken line positions in synchronism with said movement of the lens 16.

On the other hand, when the apparatus is in $\beta$ magnification image formation mode, if the magnification mode changing switch is closed, the solenoid 47 is first energized as described above and the stopper 42 is drawn out of the cut-away 41, and then the motor 38 is rotated in reverse direction to rotatively drive the pulley 36 clockwisely, thus moving the lens 16 leftwardly in parallelism to the optical axis A, as viewed in FIG. 2. In synchronism with the initiation of revolution of the motor 38, the motor 57 starts its revolution and again rotates the cam plate 55 through 180°, so that the pin 54 comes to bear against the cam surface 56' in the area **56'*a*, whereby the stopper 42 and the magnet 70 are returned to their positions for one-to-one magnification image formation mode. After the return of the stopper 42 and magnet 70 to their original positions, the lens bed 25 reaches a position in which the cut-away 40 is rendered engageable with the stopper 42 and at this time, the element 71 becomes opposed to the magnet 70, so that this element 71 forms a signal, by which the motor 38 is deenergized to stop the movement of the lens 16 and at the same time, the solenoid 47 is also deenergized to permit the spring 49 to cause the stopper 42 to come into the cut-away 40. By this time, the lens 16 has been moved over said distance $\{(1-\beta)f+\Delta L\}$ and returned to a position corresponding to $\Delta f$ for one-to-one magnification image formation mode, and is located at this position by the engagement between the stopper 42 and the cut-away 40. The mirrors 14 and 15 are also moved from their broken line positions to their solid line positions in synchronism with said movement of the lens (see FIG. 2**).

In the above-described example, the position of the stopper 42 during $\beta$ magnification image formation mode has been varied correspondingly to the error of the focal length of the lens, whereas the position of the stopper 42 may be made invariable irrespective of the presence of the error of the focal length of the lens and for example, the position of the cut-away 41 may be adjusted correspondingly to $\Delta f$. Such an example is shown in FIG. 4.

Figure 4:
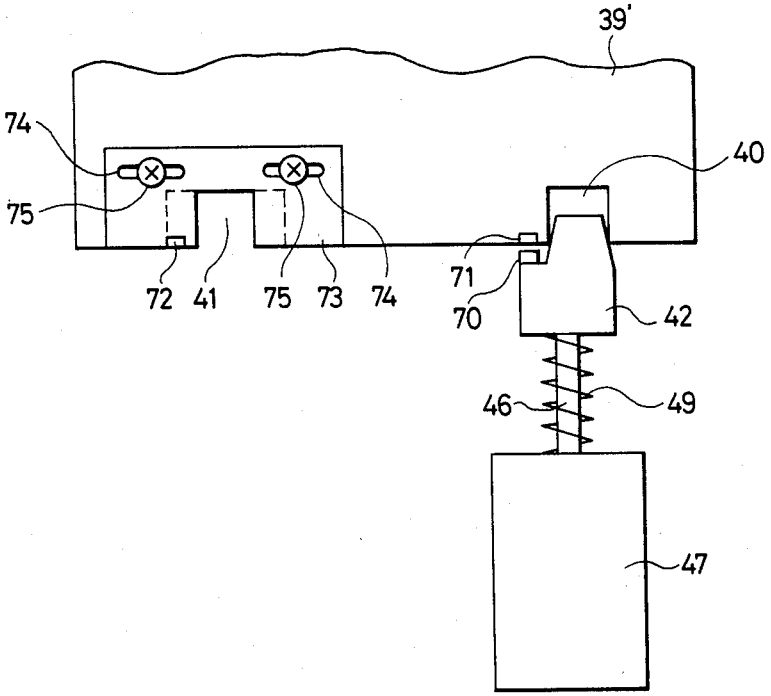
FIG. 4 illustrates an example of means for correcting the amount of movement of the lens.

In FIG. 4, reference numeral 39' designates a positioning plate fixed to the second lens bed 29 similarly to the plate 39 of FIG. 2. The positioning plate 39' has a cut-away 40 with which the stopper 42 may come into engagement during one-to-one magnification image formation mode. Denoted by 73 is a plate piece having a cut-away 41 with which the stopper 42 may come into engagement during $\beta$ magnification image formation mode. The plate piece 73 is provided with slots 74 elongated in a direction parallel to the optical axis of the lens (namely, a direction parallel to the direction of movement of the lens). By fitting screws 75 into these slots 74 and threading them into the plate 39', the plate piece 73 is fixed to the plate 39'. The stopper 42 is fixed to a plunger shaft 46 connected to a solenoid 47 and accordingly, it retracts or plunges only in a direction perpendicular to the optical axis of the lens upon energization or deenergization of the solenoid 47 and does not move in a direction parallel to the optical axis of the lens. The stopper 42 is biased by the resilient force of a spring 49 so as to plunge into said cut-away when the solenoid 47 is deenergized.

Now, in the example of FIG. 4, the positional adjustment of the lens 16 during one-to-one magnification image formation mode is as described previously, but the positional adjustment of the lens 16 during $\beta$ magnification image formation mode is accomplished by loosening the screws 75 and moving and adjusting the plate piece 73 to left and right under the guidance of the slots 74 and screws 75, in other words, changing the position of the cut-away 41 relative to the cut-away 40 in a direction parallel to the direction of movement of the lens. When the spacing between the cut-aways 40 and 41 has become a spacing corresponding to $\Delta f$, and more particularly, when the spacing between the cut-aways 40 and 41 has become said spacing $\{(1-\beta)f+\Delta L\}$ ($\Delta L$ also is 0 when $\Delta f$ is 0), the screws 75 are tightened to fix the plate piece 73 to the plate 39'. The operation mode of the device is just the same as what has been previously described with the exception that the magnet is fixed to the stopper 42 while the element 72 is fixed to the plate piece 73 (accordingly, with the positional adjustment of the plate piece 73, the element 72 is moved and adjusted by the same amount as the cut-away 41) and that the stopper 42 is not moved parallel to the optical axis of the lens.

In any case, as described above, the amount of movement of the lens during magnification changing operation is corrected correspondingly to the error of the focal length of the lens and the lengths of the optical paths before and behind the lens are both corrected, whereby an exactly focused image can be formed in any magnification copy mode. The amount of movement of the lens during magnification changing operation is generally great as compared with the amount of movement of the mirrors and therefore, according to the present embodiment, the accuracy of focusing of the image can be further improved.

There are many apparatuses designed such that the side edge portions of an original image of any magnification are imaged on the side edge portions of the photosensitive surface. Such apparatuses are usually designed such that during magnification changing operation, the lens is moved in a direction inclined with respect to the optical axis (namely, a direction in which a direction parallel to the optical axis of the lens and a direction perpendicular to the optical axis of the lens are combined), whereby the side edge portions of the original image are imaged on the side edge portions of the photosensitive surface even after the magnification is changed. In such apparatuses, if the amount of movement of the lens with respect to the direction parallel to the optical axis is simply corrected correspondingly to $\Delta f$, the lens will deviate from its designated position and therefore, the side edge portions of the resultant reduced or enlarged image will be imaged while deviating from predetermined locations on the photosensitive surface. This may cause unallowable lack of the area of the side edge portions of the reduced or enlarged image of the original from recording paper or may cause creation of unallowable blank in the area of the side edge portions of the recording paper.

The ensuing embodiment overcomes these inconveniences.

The present invention chiefly intends to provide a variable magnification optical device which overcomes the above-noted inconveniences.

Figure 5:
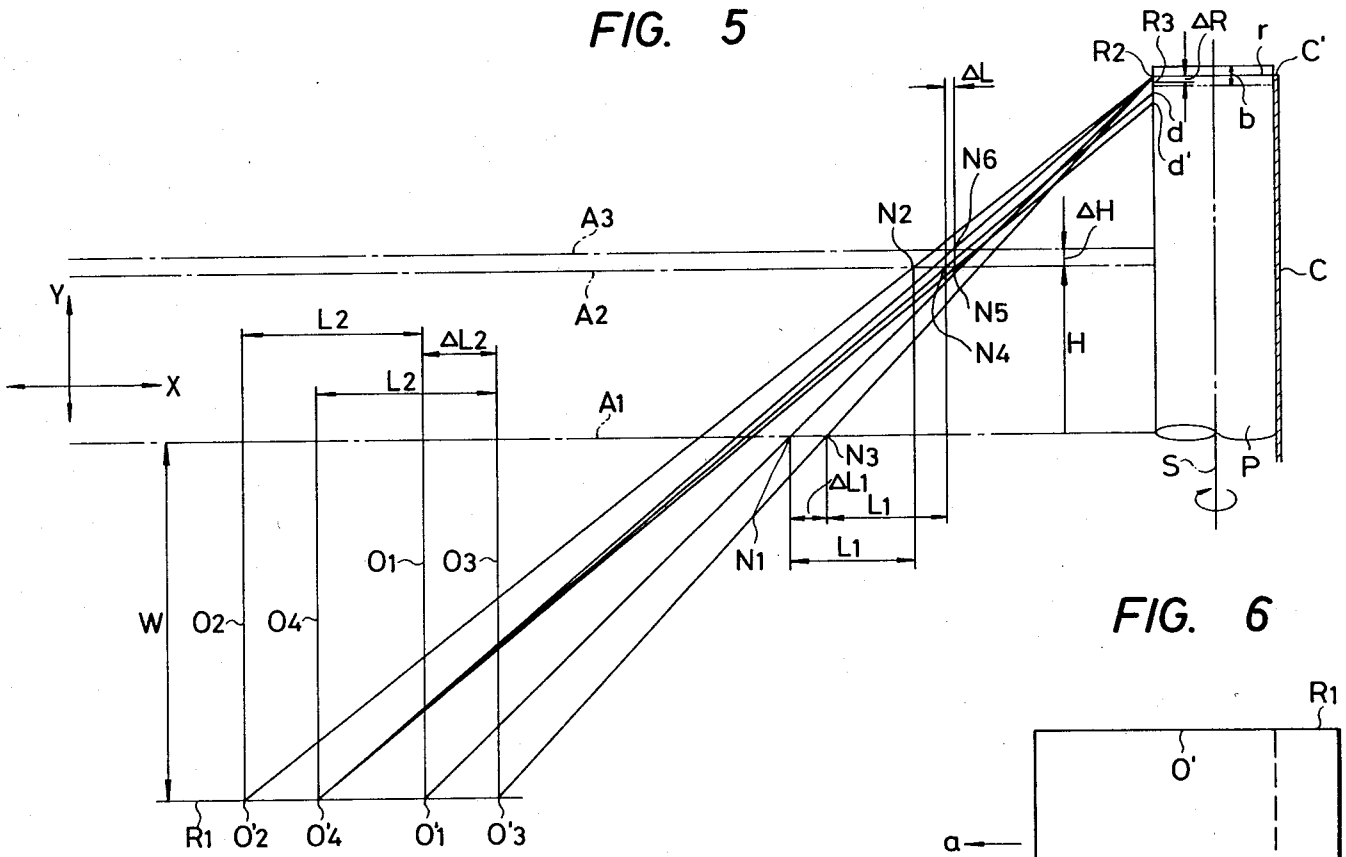
FIG. 5 is a view for explaining the principle of another embodiment of the present invention.
Figure 6:
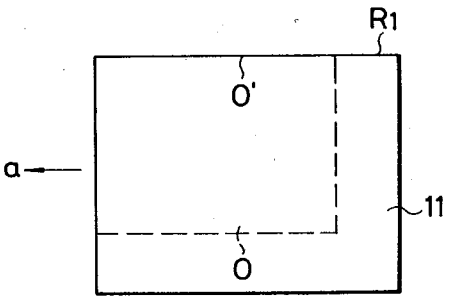
FIG. 6 is a plan view of an original supporting table.

FIG. 5 is a developed model view of an optical path for illustrating an embodiment of the present invention. In FIG. 5, P designates the drum-shaped electrophotographic photosensitive medium shown in FIG. 1 and rotatable about an axis S. $O_1$ indicates the optical position of the original during one-to-one magnification image formation mode when the lens 16 has a focal length f as per the design value. $O_2$ indicates the optical position of the original during $\beta$ magnification image formation mode when the lens 16 has the focal length f. (In case of FIG. 5, it is to be understood that $0<\beta<1$.) Both the side edge $O_1'$ of the original during one-to-one magnification image formation mode and the side edge $O_2'$ of the original during $\beta$ magnification image (reduced image) formation mode are disposed on the original supporting surface in coincidence with a common reference line $R_1$. As shown in FIG. 6, this common reference line $R_1$ is provided on the side edge portion with respect to a direction perpendicular to the original scanning direction of the original carriage 11 (i.e., the direction of movement of the original carriage). During one-to-one magnification image formation mode, the lens 16 having the focal length f is disposed at a position $N_1$. At this time, both the length of the optical path between the original position $O_1$ and the lens position $N_1$ and the length of the optical path between the lens position $N_1$ and the photosensitive medium P are 2f. By the lens 16 lying at the position $N_1$, the side edge $O_1'$ of the original is imaged at a point $R_2$ on the side edge of the photosensitive medium P side with respect to a direction perpendicular to the direction of movement thereof. When a $\beta$ magnification image is to be formed, the lens having the focal length f is moved in a direction in which a direction parallel to the optical axis of the lens (X direction) and a direction perpendicular to the optical axis of the lens (Y direction) are combined, or in other words, a direction inclined with respect to the optical axis of the lens, and is brought to a position $N_2$. The spacing $L_1$ between the position $N_1$ and the position $N_2$ with respect to X direction is $(1-\beta)f$ as previously mentioned, and the spacing H between the position $N_1$ and the position $N_2$ with respect to Y direction is $$\frac{1-\beta}{1+\beta}W.$$

(W is the distance between the optical axis $A_1$ of the lens 16 at the position $N_1$ and the reference line $R_1$.) Also, the lens is moved to the position $N_2$ while, at the same time, the mirrors provided in the optical path between the lens and the original are moved, whereby the optical position of the original is changed from $O_1$ to $O_2$, or in other words, the length of the optical path between the original and the photosensitive medium is prolonged by $L_2$. As previously mentioned, $L_2$ is $$\frac{(1-\beta)^2}{\beta} f.$$

By the lens being moved by the distance $L_1$ in X direction and the length of the entire optical path being prolonged by $L_2$, a focused $\beta$ magnification image of the original is formed on the photosensitive medium and, by the lens being moved by the distance H in Y direction, the image of the side edge $O_2'$ of the original at the position $O_2$ is formed at a position $R_2$ on the photosensitive medium. $A_2$ designates the optical axis of the lens 16 at the position $N_2$.

The image of the original formed on the photosensitive medium P is transferred to transfer paper C and, in the present embodiment, the separating member 7 (see FIG. 1) such as a belt or a pawl for separating the transfer paper C from the photosensitive medium P after the image transfer is in contact with or in proximity to the photosensitive medium on one end edge side thereof. More particularly, the separating member 7 is in contact with or in proximity to the photosensitive medium at a narrow area b containing therein the circumferential line r of the photosensitive medium P containing the point $R_2$. In this case, the transfer paper C is conveyed by the conveyor roller 5 so that during any magnification image formation mode, the side edge C' thereof with respect to a direction perpendicular to the direction of conveyance thereof is positioned in said area b and contacts the photosensitive medium P. While, in FIG. 5, the side edge C' is in coincidence with the circumferential line r, it may be positioned anywhere in the area b. The transfer paper C is separated from the photosensitive medium P by the narrow portion of the side edge C' of the transfer paper being engaged with the separating member.

Description will now be made of a case where use is made of a lens whose focal length includes an error $\Delta f$ from the design value f (in FIG. 5, $\Delta f<0$), or in other words, a lens 16 whose focal length is $(f+\Delta f)$. In order that a focused one-to-one magnification image of the original may be formed, the position of the lens 16 is corrected to a position $N_3$ on the optical axis $A_1$ (accordingly, the optical axis of the lens 16 at the position $N_3$ also is $A_1$) while, at the same time, the positions of the mirrors 14 and 15 disposed in the optical path between the original supporting portion and the lens are adjusted, whereby the length of the optical path between the original supporting portion and the photosensitive medium is corrected and the optical position of the original is corrected to $O_3$. The spacing $\Delta L_1$ between the position $N_1$ and the position $N_2$ is $|2\Delta f|$ as previously mentioned, the amount of correction of the length of the entire optical path, namely, the spacing $\Delta L_2$ between the position $O_1$ and the position $O_3$, is $|4\Delta f|$ as previously mentioned, and both the length of the optical path between the position $O_3$ and the position $N_3$ and the length of the optical path between the position $N_3$ and the photosensitive medium P are $2(f+\Delta f)$. By such correction, a focused one-to-one magnification image of the original can be formed on the photosensitive medium P, and the image of the side edge $O_3'$ (coincident with the reference line $R_1$) of the original at the position $O_3$ is formed at a position $R_2$. $A_1$ is also the optical axis of the lens 16 lying at the position $N_3$.

Subsequently, the mirrors 14 and 15 are moved by magnification changing operation, whereby the length of the entire optical path is prolonged by $L_2$ and the optical position of the original becomes $O_4$. If, by this magnification changing operation, the lens 16 is moved by the distance $L_1$ in X direction and by the distance H in Y direction and brought to a position $N_4$, a focused image of the original will not be obtained on the photosensitive medium because the focal length of the lens 16 is $(f+\Delta f)$. Also, the image of the side edge $O_4'$ of the original will be formed at a position different from $R_2$, or in the figure, at a point d deviated from the area b.

Therefore, in the present embodiment, in order that a focused image of the original may be obtained on the photosensitive medium and that the image of the side edge $O_4'$ of the original may be formed at the position $R_2$, the amount of movement of the lens in X direction during magnification changing operation and the amount of movement of the lens in Y direction are corrected correspondingly to the error of the focal length of the lens, whereby the position of the lens 16 is corrected to a position different from position $N_4$. First, the amount of correction $\Delta L$ of the amount of movement of the lens in X direction, as will be seen from what has been previously described, can be obtained as:

$$\Delta L = \frac{(\beta^2-1)f + \sqrt{\{(1+\beta)^2 f + 4\beta\Delta f\}(1-\beta)^2 f}}{2\beta}$$

Thus, in $\beta$ magnification image formation mode, the lens 16 is disposed at such a position that the length of the optical path between the lens and the original position $O_4$ is P and that the length of the optical path between the lens and the photosensitive medium is Q. As previously mentioned, P and Q are expressed as follows:

$$P = \frac{(1+\beta)^2 f + 4\beta\Delta f + \sqrt{\{(1+\beta)^2 f + 4\beta\Delta f\}(1-\beta)^2 f}}{2\beta}$$

$$Q = \frac{(1+\beta)^2 f + 4\beta\Delta f - \sqrt{\{(1+\beta)^2 f + 4\beta\Delta f\}(1-\beta)^2 f}}{2\beta}$$

Accordingly, the lens 16 is displaced by a distance $\Delta L$ from the position $N_4$ in the direction X of the optical axis, whereby an image Q/P times the original lying at the optical position $O_4$ (Q/P is a value very approximate to $\beta$ because $\Delta f$ is usually very small) is formed in focused condition on the photosensitive medium P. $\Delta L$ can be expressed by the aforementioned equation.

Now, when the lens 16 has been simply moved by the distance $\Delta L$ from the position $N_4$ to the position $N_5$ on the optical axis $A_2$, an image Q/P times the image of the original is formed in focused condition on the photosensitive medium, but the side edge $O_4'$ of the original is imaged at a position d' remoter from the area b than the position d. Accordingly, in order that the side edge $O_4'$ of the original may be imaged at the position $R_2$ in focused condition, the lens 16 must be moved not only by $\Delta L$ from the position $N_4$ in X direction but also by $\Delta H$ corresponding to $\Delta f$ in Y direction and brought to a position $N_6$. $\Delta H$ can be expressed by the following equation:

$$\Delta H = \frac{P-Q}{P+Q} W - H$$

-continued $$= \frac{\sqrt{\{(1+\beta)^2 f + 4\beta\Delta f\}(1-\beta)^2 f}}{(1+\beta)^2 f + 4\beta\Delta f} W - \frac{1-\beta}{1+\beta} W$$

Thus, during $\beta$ magnification image formation mode, the lens whose focal length is $(f+\Delta f)$ is moved by a distance $(L_1+\Delta L)$ in X direction from its position during one-to-one magnification image formation mode and by a distance $(H+\Delta H)$ in Y direction, whereby a focused reduced image of the original can be formed on the photosensitive medium P and the side edge of the original can be imaged at the position $R_2$. If the lens is moved in X direction, the ratio of the lengths of the optical paths before and behind the lens will be varied. However, if the lens is moved in Y direction, the ratio of the lengths of said optical paths will not be varied but the position of the image on the photosensitive medium will change.

In the above-described example, the position whereat the side edge of the original is imaged is the same position $R_2$ for both one-to-one magnification image formation mode and $\beta$ magnification image formation mode, but the position whereat the side edge of the original is imaged may be $R_2$ during one-to-one magnification image formation mode and may be a position $R_3$ different from $R_2$ during $\beta$ magnification image formation mode. In that case, the position $R_3$ should desirably be set in the contact area b of the separating member. In any case, assuming that $\Delta R$ is the spacing between the position $R_2$ and the position $R_3$, the aforementioned H and $\Delta H$ can be expressed as follows:

$$H = \frac{(1-\beta)W - \Delta R}{1+\beta}$$

$$\Delta H = \frac{(P-Q)W - P\Delta R}{P+Q} - \frac{(1-\beta)W - \Delta R}{1+\beta}$$

In an apparatus wherein the image of the area b is erased before image transfer, the position $R_3$ whereat the side edge of the reduced image is projected as described above may be set more toward the central position of the photosensitive medium than the position $R_2$, thereby reducing the amount of lack of recorded information when a reduced image of the original is recorded.

In FIG. 1, there is shown an example of the means for making the area b into an image non-formation area. Designated by 4 is a lamp disposed at a suitable position between the charger 1 and the developing device 3, in the figure, at a position between the original image exposure station and the developing device 3. The lamp 4 illuminates the area b of the photosensitive medium P. By this, the charge imparted to the area b by the charger 1 is erased and thus, no developer can adhere to the area b. As another method for preventing developer from adhering to the area b, there is a method of disposing an electrical shield plate between the charger 1 and the area b to block the arrival of corona discharge current at the area b. In any case, by preventing adherence of developer to the area b and making the area b into a non-image area as described above, the separating member 7 can be prevented from being contaminated by developer.

In any case, when the mode is to be changed from one-to-one magnification image formation mode to $\beta$ magnification image formation mode, the lens whose focal length is f as per the design value is moved by the distance $L_1$ in X direction and by the distance H in Y direction, while the lens whose focal length includes the error $\Delta f$ is moved by the distance $(L_1+\Delta L)$ in X direction and by the distance $(H+\Delta H)$ in Y direction, whereby both a one-to-one magnification image and a reduced image of the original can be formed on the photosensitive medium in focused condition and the side edge portion of the original image can be imaged at a predetermined location on the photosensitive medium. $(L_1+\Delta L)$ is a function of $\Delta f$ and $(H+\Delta H)$ also is a function of $\Delta f$ and therefore, if the amount of movement $(L_1+\Delta L)$ of the lens 16 in X direction is determined correspondingly to $\Delta f$, the amount of movement of the lens 16 in Y direction will be primarily determined or, if the amount of movement $(H+\Delta H)$ of the lens 16 in Y direction is determined correspondingly to $\Delta f$, the amount of movement of the lens 16 in X direction will be primarily determined. This brings about an advantage that as in an embodiment to be described, a simple can be used for the correction of the lens position corresponding to $\Delta f$.

FIG. 5 exemplifies a case where $\Delta f$ is negative and $\beta$ is smaller than 1, but what has been described above also applies to a case where $\Delta f$ is positive and $\beta$ is greater than 1, and the present invention is also applicable to the case where $\Delta f$ is positive and $\beta$ is greater than 1.

In FIG. 5, $A_1$ designates the optical axis of the lens lying at the positions $N_1$ and $N_3$, $A_2$ denotes the optical axis of the lens lying at the positions $N_2$, $N_4$ and $N_5$, and $A_3$ designates the optical axis of the lens lying at position $N_6$. The above expression that the lens lies at the positions $N_1, \ldots, N_6$ roughtly means that the lens is disposed with its principal point located at the positions $N_1, \ldots, N_6$, respectively.

Figure 7:
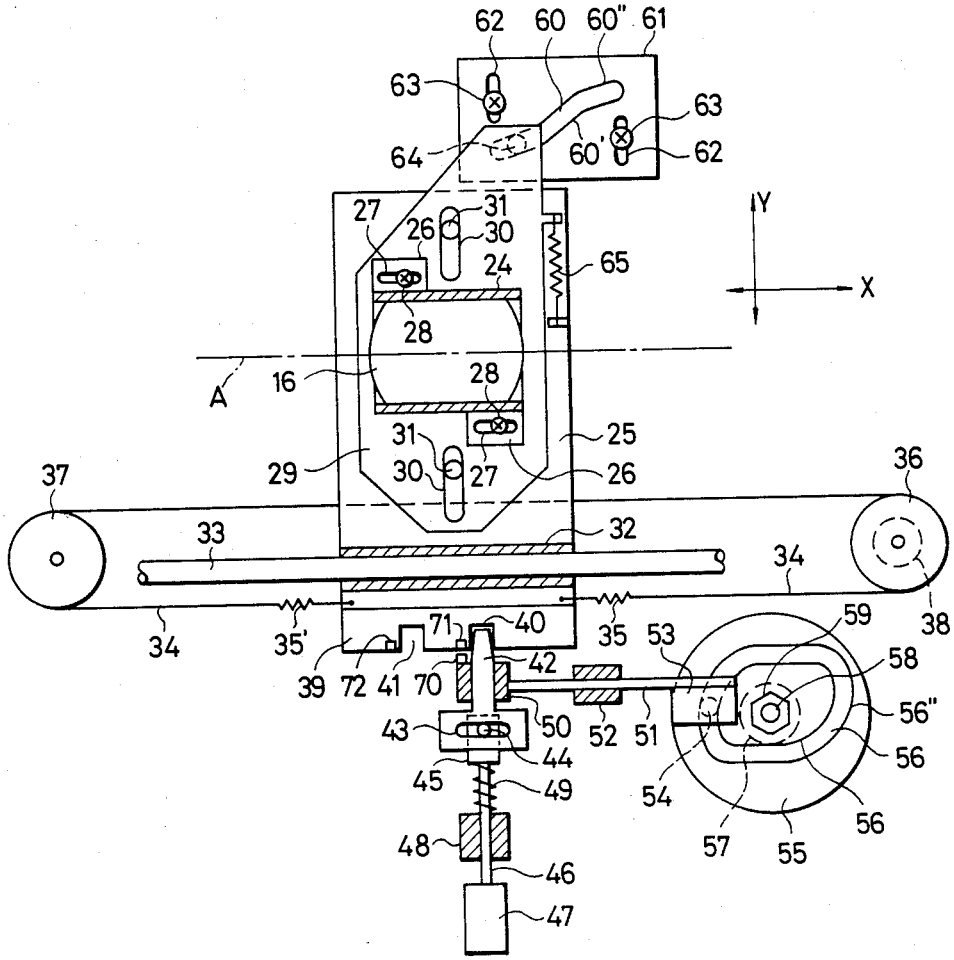
FIG. 7 illustrates another embodiment of the present invention.

Reference is now had to FIG. 7 to describe an example of the lens moving mechanism which carries out the principle of FIG. 5. FIG. 7 is a plan view, partly in cross-section, of the lens moving mechanism. In FIG. 7, members and means similar in function to those of the FIG. 2 embodiment are given similar reference numerals and for simplicity of description, these will not be described unless required.

Referring to FIG. 7, a lens barrel 24 is fixed to a first lens bed (first lens carriage) 29. The lens barrel 24 has a mounting plate 26 which has a slot 27 elongated in a direction X parallel to the optical axis A of the lens (namely, the direction of movement of the lens carriage 25). By fitting a screw 28 into the slot 27 provided for the same purpose as that described in connection with FIG. 2 and threading the screw into the first lens bed 29, the lens barrel 24 and accordingly the lens 16 is fixed to the first lens bed 29.

The first lens bed 29 is slidably supported on a second lens bed (second lens carriage) 25. The first lens bed 29 has a slot 30 elongated in a direction Y perpendicular to the optical axis A of the lens (namely, a direction perpendicular to the direction of movement of the lens carriage 25, this direction Y being also a direction perpendicular to the original scanning direction a), and this slot 30 is slidably fitted over a pin 31 studded in the second lens bed 25. Under the guidance of the slot 30 and pin 31, the first lens bed 29 is movable in the direction of arrow Y relative to the second lens bed 25. However, if a motor 38 is energized to move the second lens bed 25 in X direction, the first lens bed 29 will be moved by the same distance as the distance of movement of the second lens bed 25 by being pushed by the pin 31. In other words, during magnification changing operation, the lens 16 is moved in X direction by the same distance as the distance of movement of the second lens bed 25.

Designated by 61 is a cam plate. This cam plate 61 is provided with a slot 62 elongated in Y direction, and a screw 63 is fitted in the slot 62. The cam plate 61 is fixed by threading the screw 63 into an immovable member such as a beam member of the copying apparatus body. A slot cam 60 is provided in the cam plate 61 and comprises two opposed cam surfaces 60' and 60''. A pin 64 as a cam follower is fitted in the slot cam 60 and slidably bears against the cam surfaces 60' and 60''. The pin 64 is studded in the first lens bed 29. A tension spring 65 extends between and is secured to the first lens bed 29 and the second lens bed 25 to ensure the pin 64 to be engaged with the slot cam 60, and this spring 65 normally biases the first lens bed 29 on the second lens bed 25 in a direction parallel to the lengthwise direction of the slot 30. The slot cam 60 is inclined with respect to X direction and Y direction and accordingly, if the second lens bed 25 is moved in X direction, the first lens bed 29 fixedly supporting the lens 16 will be moved in X direction by the same amount as the second lens bed 25 and also relatively moved on the second lens bed 25 in Y direction under the guidance of the pin 31 and slot 30. The amount of relative movement of the first lens bed in Y direction is determined by the slot cam 60. Thus, during magnification changing operation, the lens 16 is moved by the drive of a pulley 36 in a direction in which X and Y directions are combined, or in other words, a direction inclined with respect to the optical axis A. Of course, the movement locus of the pin 64 along the cam slot 60 is parallel to the movement locus of the lens 16 fixed to the first lens bed 29. That is, the lens 16 is moved in the same direction as the direction of movement of the pin 64 and by the same amount as the amount of movement of the pin 64.

Now, by the same mechanism as that described in connection with FIG. 2, the amount of movement of the lens 16 in X direction during magnification change is corrected correspondingly to the error $\Delta f$ of the focal length of the lens.

In the device of FIG. 7, the amount of movement of the lens 16 in Y direction during magnification changing operation is corrected correspondingly to $\Delta f$ by the cam 60.

As previously described, the cam plate 61 is fixed to an immovable member by screws 63. After the positional adjustment of the lens 16 in a direction along the optical axis A during one-to-one magnification image mode is completed in the described manner, or in other words, after the position of the lens with respect to the direction along the optical axis A in which a one-to-one magnification image of the original can be formed on the photosensitive medium in exactly focused condition is determined, positional adjustment of the slot cam 60 with respect to Y direction is effected. That is, if the screws 63 are first loosened and the cam plate 61 is moved and adjusted in Y direction under the guidance of the screws 63 and slots 62, the first lens bed 29 and accordingly the lens 16 is moved relative to the second lens bed 25 in Y direction under the guidance of the pin 31 and slot 30 since the pin 64 as a cam follower secured to an end of the first lens bed 29 is fitted in the cam slot of the cam plate 61. By this movement and adjustment of the lens in Y direction, the optical axis A of the lens is brought to a predetermined position, or in other words, the position of the optical axis of the lens during one-to-one magnification image formation mode is set so that the image of the side edge of the original is formed at the position $R_2$ (see FIG. 5) on the photosensitive medium P. In this condition, the screws 63 are again tightened to fix the cam plate 61 immovably. By the above-described positional adjustment of the lens for one-to-one magnification image formation mode, the lens 16 is positioned at the position $N_1$ of FIG. 5 when the focal length of the lens 16 is f as per the design value, and is positioned at the position $N_3$ of FIG. 5 when the error $\Delta f$ is included in the focal length.

Subsequently, as previously described, the position of the lens 16 with respect to X direction during $\beta$ magnification image formation mode is determined, or in other words, the position of the lens 16 with respect to X direction is adjusted so that an exactly focused image of the original can be formed on the photosensitive medium during $\beta$ magnification image formation mode. In the embodiment of FIG. 7, if the above-described position of the lens 16 during $\beta$ magnification image formation mode is adjusted corresponding to $\Delta f$ with respect to X direction, that position of the lens 16 is automatically adjusted correspondingly to $\Delta f$ with respect also to Y direction, whereby even when a reduced image of the original is to be formed by the use of a lens in which $\Delta f$ is not 0, the image of the side edge O' of the original can be formed at predetermined location in the aforementioned area b (see FIG. 5) on the side edge side of the photosensitive medium P. The positional adjustment of the lens 16 with respect to Y direction may be effected during the positional adjustment of the lens for $\beta$ magnification image formation mode.

Figure 8:
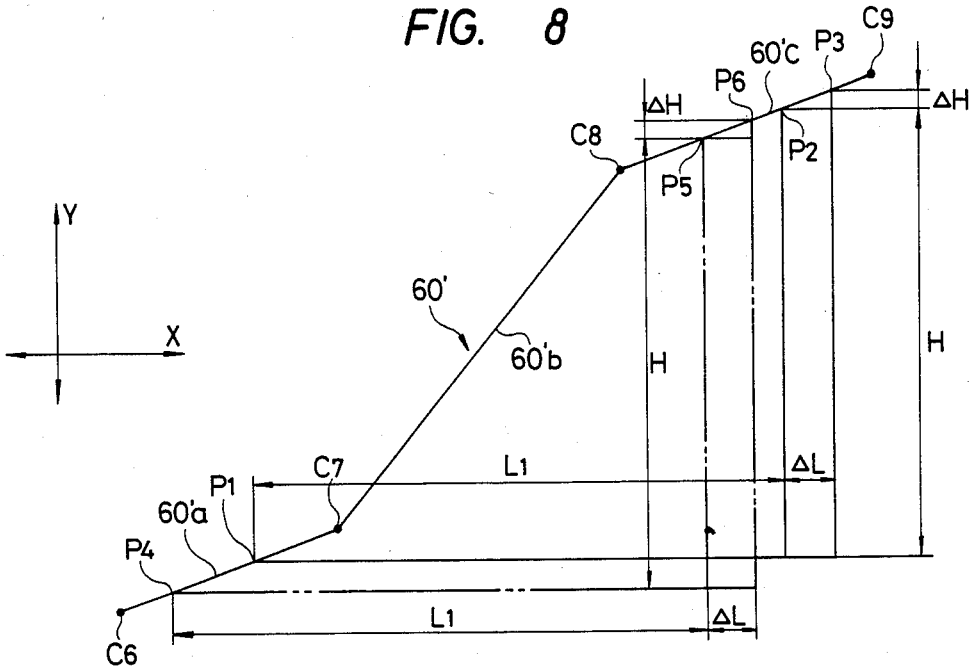
FIG. 8 illustrates another cam for correcting the amount of movement of the lens.

The slot cam 60 will be described in greater detail by reference to FIG. 8. FIG. 8 shows the configuration of the cam surface 60' of the slot cam 60. The cam surface 60'' also has a configuration similar to that of the cam surface 60'. As shown in FIG. 8, the cam surface 60' comprises three areas **60'*a*, 60'*b* and 60'*c*. The area 60'*a* is the section from point $C_6$ to point $C_7$, the area 60'*b* is the section from point $C_7$ to point $C_8$, and the area 60'*c* is the section from point $C_8$ to point $C_9$. During one-to-one magnification image formation mode, the pin 64 bears against the cam surface 60' in the area 60'*a* and, during $\beta$ magnification image formation mode, the pin 64 bears against the cam surface 60' in the area 60'*c*. The area 60'*b* is a communicating path between the areas 60'*a* and 60'*c* and guids the movement of the pin 64 between the areas 60'*a* and 60'*c***.

Now, it is to be understood that during one-to-one magnification image formation mode, the pin 64 bears against the cam surface 60' at point $P_1$. During magnification changing operation, when there is no error in the focal length of the lens 16, the second lens bed 29 is moved by a distance $L_1$ in X direction, as previously described. Accordingly, the pin 64 is also moved by the distance $L_1$ in X direction, and after all, the pin 64 arrives at point $P_2$ in the area **60'*c* because it is moved along the cam surface 60'. At this time, the amount of movement of the pin 64 in Y direction, or in other words, the distance between the points $P_1$ and $P_2$ in Y direction, is H. Accordingly, when $\Delta f$ is 0, the lens is moved from position $N_1$ to position $N_2$ by the mode changing operation from one-to-one magnification image formation mode to $\beta$ magnification image formation mode. On the other hand, when $\Delta f$ is not 0, the second lens bed 29 is moved by a distance $(L_1+\Delta L)$ in X direction, as previously described. Accordingly, the pin 64 is moved from point $P_1$ to point $P_3$ which is a point displaced from point $P_2$ by $\Delta L$ in X direction. The point $P_3$ lies at a position displaced from point $P_2$ by about $\Delta H$ in Y direction. In other words, the area 60'C is a straight cam area and the inclination of the straight area 60'c with respect to the optical axis A (the inclination) with respect to X direction) is set so that if, in the area 60', the pin 64 is moved by a distance $\Delta L$ in X direction, this pin 64 is moved by a distance substantially equal to a distance $\Delta H$ in Y direction. Consequently, if the pin 64 is moved by a distance $(L_1+\Delta L)$ in X direction, this pin 64 will be moved by a distance $(H+\Delta H)$ in Y direction. Thus, when $\Delta f$ is not 0, the lens 16** is moved from position $N_3$ to position $N_6$ by magnification changing operation.

In a case where the mounted position of the cam plate 61 with respect to the immovable member or the mounted position of the pin 64 with respect to the first lens bed 25 may differ from apparatus to apparatus, the position in which the pin 64 bears against the cam surface 60' may also differ from apparatus to apparatus. For example, it is assumed that in a copying apparatus A, the pin 64 bears against the cam surface 60' at point $P_1$ during one-to-one magnification image formation mode and that in a copying apparatus B, the pin 64 bears against the cam surface 60' at point $P_4$ during one-to-one magnification image formation mode. Also in the copying apparatus B, in order that the lens 16 may be moved from position $N_1$ to position $N_2$ when $\Delta f$ is 0, and may be moved from position $N_3$ to position $N_6$ when $\Delta f$ is not 0, the following contrivance is applied to the cam surface 60'.

The areas 60'a and 60'b of the cam surface 60' are straight sections and the area 60'a is parallel to the area 60'c. That is, the inclination of the area 60'a with respect to the optical axis A (namely, the inclination of the area 60'a with respect to X direction) is equal to that of the area 60'c. Accordingly, point $P_5$ (a point in the area 60'c) on the cam surface 60' lying at a position displaced from the point $P_4$ by a distance $L_1$ in X direction is spaced apart from the point $P_4$ by a distance H in Y direction, and point $P_6$ displaced from $P_5$ by $\Delta L$ in X direction in the area 60'c is displaced from point $P_5$ by about $\Delta H$ in Y direction. Accordingly, against whichever location on the area 60'a the pin 64 may bear during one-to-one magnification image formation mode, the lens 16 effects a movement just similar to the above-described movement of the lens 16 in the apparatus wherein the pin 64 bears against the cam surface 60' at point $P_1$ during one-to-one magnification image formation mode.

The length of the area 60'b and the angle thereof with respect to the optical axis (the angle of inclination thereof with respect to X direction) are set so that at whatever position in the area 60'a the pin 64 may be, when the pin 64 is moved therefrom by a distance $L_1$ in X direction, the pin 64 arrives at some position in the area 60'c and said some position is spaced apart by a distance H from the position in the area 60'a against which the pin 64 has initially borne. Thus, the angle of the area 60'b with respect to the optical axis A differs from the angle of the area 60'c with respect to the optical axis A and accordingly, from the angle of the area 60'a with respect to the optical axis A.

In the example of FIG. 8, the area 60'a is a straight section, but alternatively it may be a curved section.

If the relative positional relation between the pin 64 and the cam surface 60' during one-to-one magnification image formation mode is adjusted by making adjustable the mounted position of the pin 64 with respect to the first lens bed 25 so that in any copying apparatus the pin 64 may bear against the cam surface, for example, at the point $P_1$ during one-to-one magnification image formation mode, the area 60'c can be made into a curved section more exactly corresponding to the relation between $\Delta L$ and $\Delta H$ expressed by the aforementioned equation with $\Delta f$ as a variable and, in this case, the position of the lens during reduction copying (in which $\Delta f$ is not 0) can be made nearer to the theoretical position.

The error $\Delta f$ of the focal length of a lens, if any, is a fixed value to that lens. Also, the relative positional relation between the pin 64 and the cam surface during one-to-one magnification image formation mode, once fixed in an apparatus, is invariable to that apparatus. Accordingly, in order that the amount of displacement in Y direction relative to the displacement $\Delta L$ of the pin 64 in X direction may be made more approximate to the aforementioned theoretical value, use may be made of means for adjusting the position at which the pin 64 bears against the cam surface during $\beta$ magnification image formation mode, with respect to Y direction correspondingly to the inherent $\Delta f$ of the lens used. An example of such means is shown in FIG. 9.

Figure 9:
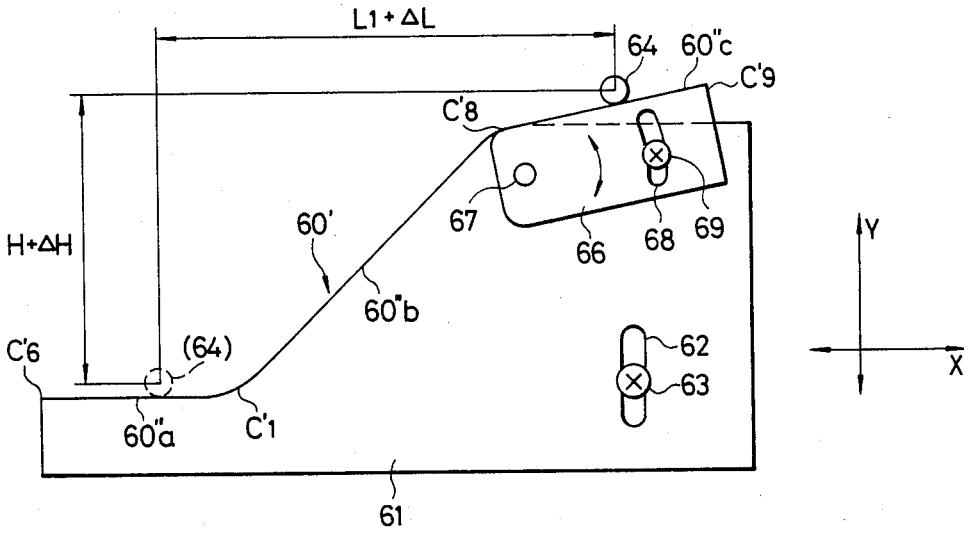
FIG. 9 illustrates still another cam for correcting the amount of movement of the lens.

The cam plate 61 of FIG. 9 has a cam surface 60' against which the pin 64 bears with the aid of the spring force of a spring 65. The cam surface 60' comprises an area 60''a between points $C_6'$ and $C_7'$, an area 60''b between points $C_7'$ and $C_8'$, and an area 60''c between points $C_8'$ and $C_9'$. The pin 64 bears against the area 60''a during one-to-one magnification image formation mode and bears against the area 60''c during $\beta$ magnification image formation mode, and the area 60''b bridges the areas 60''a and 60''c. What has been described above is similar to the cam surface 60' of FIG. 8, but in the cam surface of FIG. 9, the area 60''c is formed on a plate piece 66. The plate piece 66 is mounted on the cam plate 61 by means of a shaft 67 for pivotal movement as indicated by an arrow. The plate piece 66 is provided with an arcuate slot 68 centered at the shaft 67, and the plate piece 66 is fixed to the cam plate 61 by a screw 69 being fitted in the slot 68 and threaded into the plate 61.

Where the cam of FIG. 9 is used, the screw 63 is loosened with the pin 64 bearing against the cam surface 60' at a suitable position in the area 60''a, for example, a position 64, the position of the cam plate 61 is adjusted with respect to Y direction, and as previously described, the position of the lens 16 with respect to Y direction during one-to-one magnification image formation mode is determined. When the position of the lens in which the image of the side edge of the original can be formed at the position $R_2$ is determined, the screw 63 is then tightened to fix the cam plate 61 to the immovable member. Subsequently, the lens 16 is moved in X direction by a distance $(L_1+\Delta L)$ corresponding to the error $\Delta f$ of the focal length of that lens (if $\Delta f$ is 0, $\Delta L$ is 0) and is brought to a position in which a focused reduced image of the original can be formed on the photosensitive medium P. At this time, the pin 64 is also moved by the distance $(L_1+\Delta L)$ from the position 64 in X direction and comes to ride onto the cam surface area 60''c of the plate piece 66. Subsequently, the screw 69 is loosened and the plate piece 66 is pivoted about the shaft 67 as indicated by arrow with the pin 64 bearing against the cam surface to thereby adjust the angle of inclination of the cam surface 60''c with respect to 60''a

(whereby the position of the pin 64 is adjusted in Y direction and accordingly the position of the lens is also adjusted in Y direction) and the position of the plate piece 66 in which the image of the side edge O' of the original can be formed at a predetermined location on the area b of the photosensitive medium P, for example, the point $R_2$ (see FIG. 5), is obtained. When the plate piece 66 has come to this position (at this time, the pin 64 lies at a position spaced apart by a distance of about $(H+\Delta H)$ in Y direction from the position 64), the screw 69 is again tightened to fix the plate piece 66 to the cam plate 61. Thus, the amount of movement of the pin 64 and accordingly of the lens 16 with respect to Y direction can be made more exactly approximate to the theoretical value corresponding to $\Delta f$.

In FIG. 9, the cam area 60''*a* is a straight area parallel to X direction. This is for the purpose of allowing an error in X direction at the fixed position of the cam plate 61. Also in FIG. 9, the cam area 60''*b* may be straight or curved.

In the above-described example, the areas 60'*b* and 60''*b* of the cam surface have been shown as straight cam surfaces, but alternatively, they may be curved cam surfaces.

Also, in the above-described example, the cam follower 64 is provided on the first lens bed 29 and the cam plate 61 is fixed to an immovable member, whereas alternatively, the cam plate 61 may be fixed to the first lens bed 29 with the direction of inclination of the cam surface with respect to the optical axis A being opposite to that in FIGS. 7, 8 and 9, and the pin 64 which engages the cam may be fixed to an immovable member.

Further, in the above-described example, the lens position during one-to-one magnification image formation mode is first determined and on the basis thereof, the lens position during $\beta$ magnification image formation mode is determined, whereas the lens position during $\beta$ magnification image formation mode may first be determined and on the basis thereof, the lens position during one-to-one magnification image formation mode may be determined.

For the purpose of correcting the amount of movement of the lens with respect to X direction, the mechanism described in connection with FIG. 4 may be employed in the apparatus described in connection with FIG. 7.

In the above-described example, the image can be focused very accurately on the photosensitive medium during both one-to-one magnification image formation mode and $\beta$ magnification image formation mode. If use is made of adjustment means such as the screw 20 of FIG. 1 for adjusting the positions of the mirrors 14 and 15, the magnification of the original image can be made exactly coincident with the target magnification in any mode. However, in an embodiment which will hereinafter be described, the magnification of the original image can be made exactly coincident with the target magnification during both one-to-one magnification image formation mode and $\beta$ magnification image formation mode.

Figure 10:
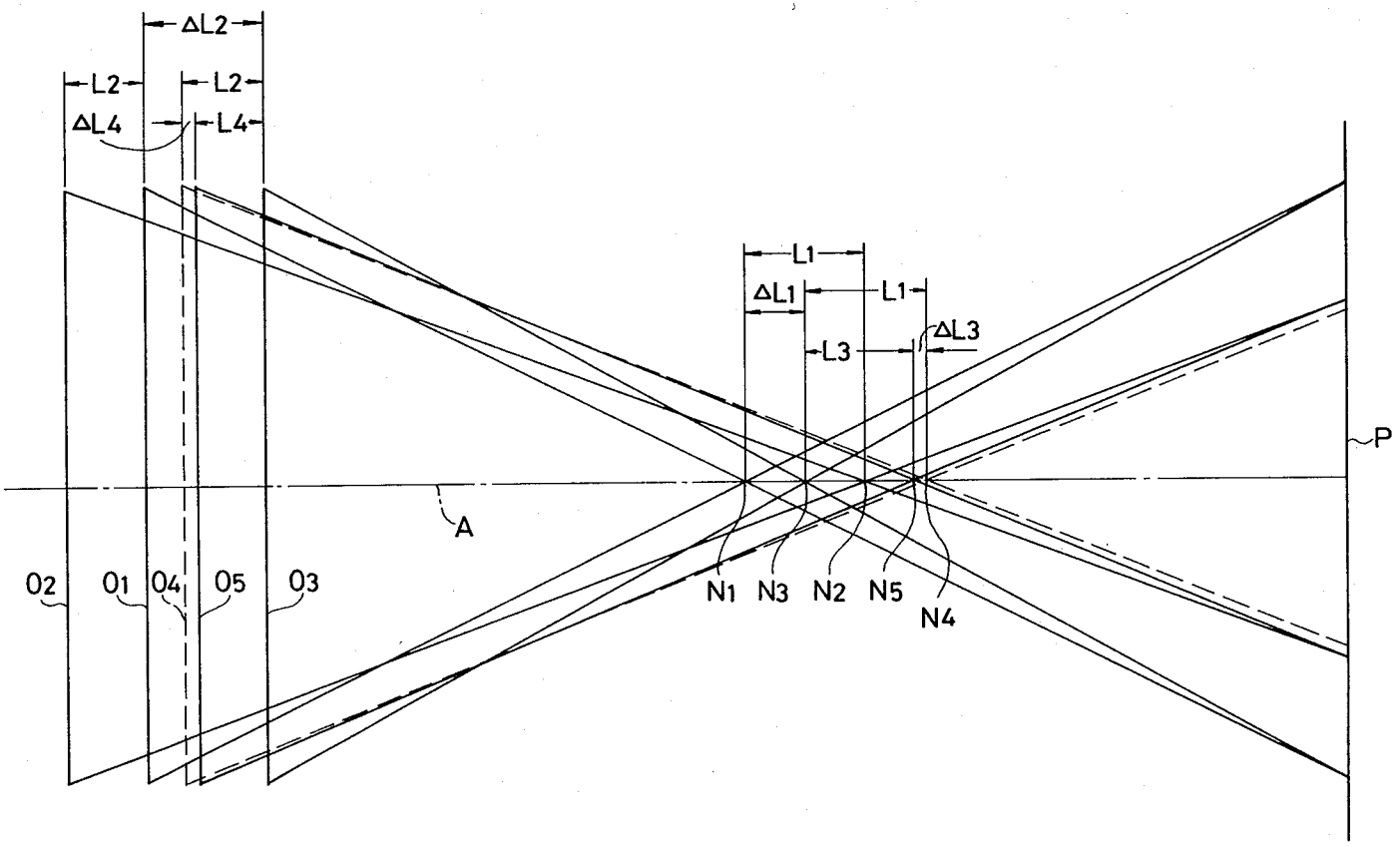
FIG. 10 is a view for explaining the principle of still another embodiment of the present invention.

In FIG. 10 which is a developed model view of the optical path for illustrating an embodiment of the present invention, P designates, for example, the electrophotographic photosensitive medium of FIG. 1. $O_1$ designates the optical position of the original during one-to-one magnification image formation mode in a case where the lens 16 has the focal length f as per the design value. $O_2$ denotes the optical position of the original during $\beta$ magnification image formation mode in a case where the lens 16 has said focal length f. (In the case of FIG. 10, it is to be understood that $0<\beta<1$.) During one-to-one magnification image formation mode, the lens 16 having the focal length f is disposed at position $N_1$. At this time, both the length of the optical path between the position $O_1$ of the original and the position $N_1$ of the lens and the length of the optical path between the position $N_1$ of the lens and the photosensitive medium P are $2f$. Thereby, a focused one-to-one magnification image of the original can be formed on the photosensitive medium P.

In order that a $\beta$ magnification image may be formed, the lens having the focal length f is moved along the optical axis A of the lens and brought to position $N_2$. The distance $L_1$ between the positions $N_1$ and $N_2$ can be expressed by the following equation as previously mentioned:

$$L_1=(1-\beta)f$$

Also, in order that a $\beta$ magnification image may be formed, the lens 16 is moved to the position $N_2$ while, at the same time, the mirrors 14 and 15 provided in the optical path between the lens 16 and the original are moved to thereby change the optical position of the original from $O_1$ to $O_2$, or in other words, the length of the optical path between the original and the photosensitive medium is prolonged by $L_2$. $L_2$ can be expressed by the following equation as previously mentioned:

$$L_2=\frac{(1-\beta)^2}{\beta}f$$

By thus making the length of the entire optical path longer by $L_2$ than that during one-to-one magnification image formation mode and moving the lens 16 from the position $N_1$ to the position $N_2$ to thereby make the ratio of the length of the optical path between the original and the lens to the length of the optical path between the lens and the photosensitive medium into $1:\beta$, a focused $\beta$ magnification image of the original can be formed on the photosensitive medium P.

Now, description will be made of a case where use is made of a lens whose focal length includes the error $\Delta f$ from the design value f (in FIG. 10, the case of $\Delta f<0$ is exemplified), or in other words, a lens 16 whose focal length is $(f+\Delta f)$. In order that a focused one-to-one magnification image of the original may be formed, the position of the lens 16 is corrected to position $N_3$ on the optical axis A while, at the same time, the positions of the mirrors disposed in the optical path between the original supporting portion and the lens are adjusted to correct the length of the optical path between the original and the photosensitive medium and thereby correct the optical position of the original to $O_3$. As previously mentioned, the spacing $\Delta L_1$ between the position $N_1$ and the position $N_3$ is $|2\Delta f|$, the amount of correction of the length of the entire optical path, namely, the spacing $\Delta L_2$ between the position $O_1$ and the position $O_3$, is $|4\Delta f|$ as previously mentioned, and both the length of the optical path between the position $O_3$ and the position $N_3$ and the length of the optical path between the position $N_3$ and the photosensitive medium P are $2(f+\Delta f)$. By such corrections, a focused one-to-one magnification image of the original can be formed on the photosensitive medium P.

Next, if, as has been done in the prior art, the lens 16 is moved by magnification changing operation by a distance $L_1$ on the optical axis A similarly to the case where the lens does not have the aforementioned focal length error and the mirrors 14 and 15 are moved to prolong the length of the optical path between the original and the photosensitive medium by $L_2$, the lens 16 will come to lie at position $N_4$ and the optical position of the original will be position $O_4$. Accordingly, in this case, the length of the optical path between the original and the photosensitive medium is $\{4(f+\Delta f)+L_2\}$, the length of the optical path between the original and the lens is $\{2(f+\Delta f)+L_1+L_2\}$, and the length of the optical path between the lens and the photosensitive medium is $\{2(f+\Delta f)-L_1\}$ and therefore, a focused $\beta$ magnification image of the original cannot be formed on the photosensitive medium by the lens 16 which lies at the position $N_4$.

Therefore, as shown in FIG. 10, in a case where the error $\Delta f$ exits in the focal length of the lens, the lens 16 is set at position $N_5$ instead of position $N_4$ during $\beta$ magnification image formation mode, and the optical position of the original is set to position $O_5$ instead of position $O_4$. In other words, the amount of movement of the lens and the amount of movement of the mirrors by the magnification changing operation are respectively corrected correspondingly to $\Delta f$.

Thus, the difference $\Delta L_3$ between the amount of movement $L_3$ of the lens 16 whose focal length has the error $\Delta f$ in the direction along the optical axis A during magnification change and the amount of movement $L_1$ of the lens 16 whose focal length does not have the error in the direction along the optical axis A during magnification change can be expressed as follows:

$$\Delta L_3=(\beta-1)\Delta f$$

Also, the difference $\Delta L_4$ between the amount of change $L_4$ of the length of the optical path between the original and the photosensitive medium during magnification change in a case where there is the error $\Delta f$ in the focal length of the lens and the amount of change $L_1$ of the length of the optical path between the original and the photosensitive medium during magnification change in a case where there is not the error in the focal length of the lens can be expressed as follows:

$$\Delta L_4 = -\frac{(1-\beta)^2}{\beta}\Delta f$$

Thus, the lens 16 whose focal length has the error $\Delta f$ is moved by a distance $(L_1-\Delta L_3)$ from the position $N_3$ during magnification change and brought to the position $N_5$ and the mirrors 14 and 15 more adjacent to the object side than the lens are moved to change the length of the optical path between the original and the photosensitive medium by a length $(L_2-\Delta L_4)$ and the optical position of the original is changed from the position $O_3$ to the position $O_5$, whereby a focused $\beta$ magnification image of the original is formed on the photosensitive medium.

$\Delta L_3$ and $\Delta L_4$ are the functions of $\Delta f$ as seen from the aforementioned equation and therefore, if $\Delta f$ is determined, $\Delta L_3$ and $\Delta L_4$ are primarily determined and accordingly, the amount of movement $(L_1-\Delta L_3)$ of the lens and the amount of change $(L_2-\Delta L_4)$ of the length of the entire optical path are primarily determined. In other words, the amount of correction of the amount of movement of the lens and the amount of correction of the amount of change of the length of the entire optical path correspond to each other.

As shown in each of the above-described embodiments, in an apparatus wherein the mirrors 14 and 15 orthogonal to each other are moved to change the length of the entire optical path, the length of the entire optical path varies at a ratio twice the amount of movement of the mirrors 14, 15. The present invention is also applicable to an apparatus in which only one mirror is moved or three or more mirrors are moved to change the length of the entire optical path and in any case, the amount of movement of the mirrors and the amount of change of the length of the entire optical path correspond to each other.

FIG. 10 exemplifies a case where $\Delta f$ is negative and $\beta$ is smaller than 1, but what has been previously described also applies to a case where $\Delta f$ is positive and $\beta$ is greater than 1, and the present invention is also applicable to a case where $\Delta f$ is positive and $\beta$ is greater than 1.

The foregoing statement that the lens lies at position $N_1, \ldots, N_5$ means that the lens is disposed with its principal point lying at position $N_1, \ldots, N_5$.

Description will hereinafter be made of a mechanism in which the principle described in connection with FIG. 10 is applied to the copying apparatus of FIG. 1. Where the principle described in connection with FIG. 10 is applied to the apparatus of FIG. 1, $L_2/2$ when there is not the error in the focal length of the lens and $L_4/2$ when there is the error $\Delta f$ in the focal length of the lens.

In other words, during one-to-one magnification image formation mode, if there is not the error in the focal length of the lens, the mirrors 14 and 15 lie at positions for rendering the optical position of the original surface into $O_1$ of FIG. 10 and, if there is the error $\Delta f$ in the focal length of the lens, the mirrors 14 and 15 lie at positions for rendering the optical position of the original surface into $O_3$ of FIG. 10. During $\beta$ magnification image formation mode, if there is not the error in the focal length of the lens, the mirrors 14 and 15 lie at positions for rendering the optical position of the original surface into $O_2$ of FIG. 10 and, if there is the error $\Delta f$ in the focal length of the lens, the mirrors 14 and 15 lie at positions for rendering the optical position of the original surface into $O_5$ of FIG. 10.

The spacing between the solid line position and the broken line position of the lens 16 is $L_1/2$ when there is not the error in the focal length of the lens, and $L_3/2$ when there is the error $\Delta f$ in the focal length of the lens. In other words, during one-to-one magnification image formation mode, the lens lies at a position corresponding to $N_1$ of FIG. 10 when there is not the error in the focal length of the lens, and lies at a position corresponding to $N_2$ of FIG. 10 when there is the error $\Delta f$ in the focal length of the lens. During $\beta$ magnification image formation mode, the lens lies at a position corresponding to $N_3$ of FIG. 10 when there is not the error in the focal length of the lens, and lies at a position corresponding to $N_5$ of FIG. 10 when there is the error $\Delta f$ in the focal length of the lens.

In the embodiments which will hereinafter be described, members and means functionally similar to those in the embodiments already described are given similar reference characters and description thereof will be omitted unless required.

Figure 11:
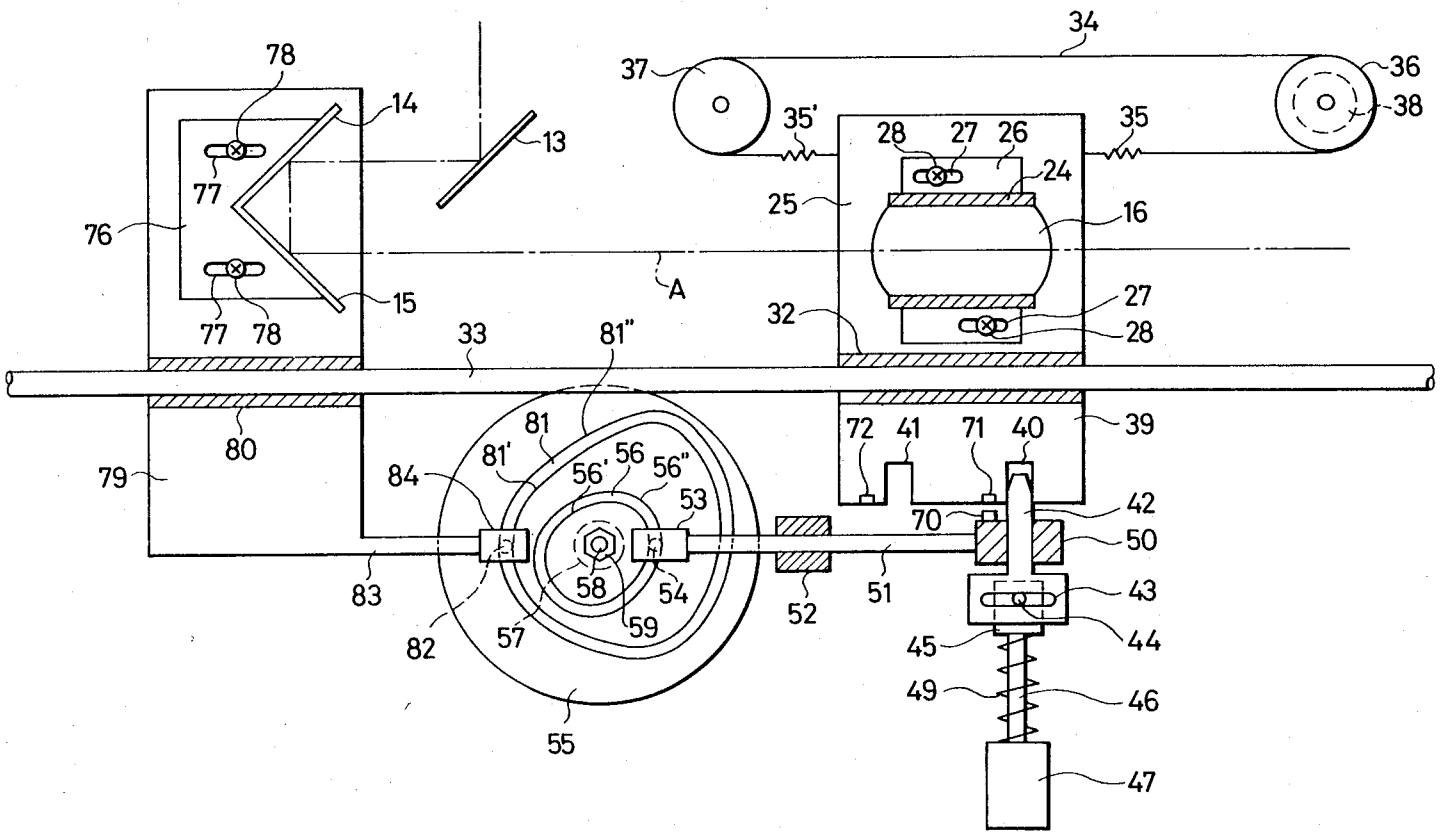
FIG. 11 illustrates yet another embodiment of the present invention.

In the embodiment of FIG. 11, the support means and moving means for the mirrors 14 and 15 differ from those of FIG. 1. In FIG. 11, the mirrors 14 and 15 are fixed to a first mirror bed 76. The first mirror bed 76 has a slot 77 therein elongated in a direction parallel to the surface of the original, or in other words, a direction parallel to the direction of movement of the mirrors 14 and 15 for the changing of the length of the entire optical path, and a screw 78 is fitted in the slot 77. The screw 78 is threaded into a second mirror bed (mirror carriage) 79, whereby the first mirror bed 76 is fixed to the second mirror bed 79. The fixed position of the first mirror bed 76 and accordingly of the mirrors 14, 15 relative to the second mirror bed 79 is adjustable with respect to a direction parallel to the surface of the original by loosening the screw 78 and moving the mirrors 14, 15 in said direction relative to the second mirror bed 79 under the guidance of the screw 78 and the slot 77.

The second mirror bed 79 has a slide bearing 80 which is elongated in a direction parallel to the surface of the original and which is slidably fitted on a guide rail 33 in the direction of its elongation. Thus, the mirrors 14 and 15 are movable with the second mirror bed 79 in the direction parallel to the surface of the original by the guidance of the guide rail 33 for the changing of the length of the entire optical path resulting from magnification change. As in the previously described embodiment, the rail 33 serves as the guide rail of the lens 16.

In the embodiment of FIG. 11, a cam plate 55 is provided with a slot cam 56 and another slot cam 81. A pin 82 is fitted in the slot cam 81 while bearing against the inner cam surface 81' and the outer cam surface 81'' of the slot cam 81. This pin 82 is studded in a pin bed 84 fixed to the end of an arm portion 83 securely studded in the second mirror bed 79 so as to interlock with the second mirror bed 79. In the embodiment illustrated, pins 54, 82 and the shaft 58 are arranged on a straight line with the shaft 58 interposed between the pins 54 and 82. As previously described, the slot cam 56 is for varying the amount of movement of the lens 16 during magnification changing operation correspondingly to the error $\Delta f$ of the focal length of the lens. The slot cam 81 is for moving the mirrors 14, 15 fixed to the bed 79 along the rail 33 to change the length of the entire optical path during magnification changing operation and for varying the amount of movement of the mirrors 14, 15 correspondingly to the error $\Delta f$ of the focal length of the lens. That is, if the fixed phase angle of the cam plate 55 relative to the shaft 58 is adjusted as previously described and thereafter a motor 57 is rotated to rotatively drive the cam plate 55, where there is not the error in the focal length of the lens, a stopper 42 is held at the same position with respect to the lengthwise direction of the rail 33 during both one-to-one magnification image formation mode and $\beta$ magnification image formation mode, but where there is the error $\Delta f$ in the focal length of the lens, the stopper 42 is displaced by a distance $\Delta L_3$ with respect to the lengthwise direction of the rail 33. By this, the lens positions during one-to-one magnification image formation mode and during $\beta$ magnification image formation mode are set correspondingly to the error of the focal length of the lens as described in connection with FIG. 10. Also, by rotation of the cam plate 55, the pin 82 engaged with the slot cam 81 is displaced by the distance $L_2/2$ with respect to the lengthwise direction of the rail 33 when there is not the error in the focal length of the lens, and is displaced by a distance $L_4/2$ differing from the distance $L_2/2$ by $L_4/2$ when there is the error $\Delta f$ in the focal length of the lens. By this, the positions of the mirrors 14 and 15 during one-to-one magnification image formation mode and during $\beta$ magnification image formation mode are set correspondingly to the error of the focal length of the lens so as to establish the position of the original surface corresponding to the error of the focal length of the lens which has been described in connection with FIG. 10.

Figure 12:
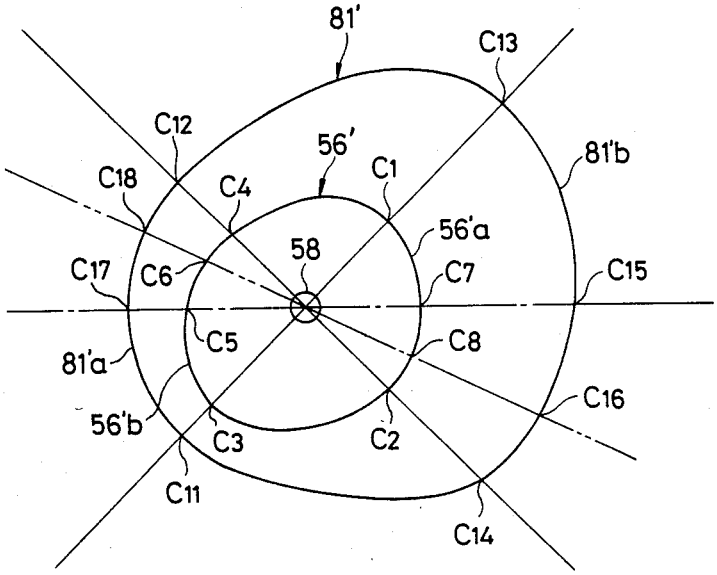
FIG. 12 illustrates a cam for correcting the amounts of movement of the lens and mirrors.

FIG. 12 shows the shapes of the inner cam surfaces 56' and 81' of slot cams 56 and 81, respectively. The shapes of the outer cam surfaces 56'' and 81'' are similar to the shapes of the inner cam surfaces 56' and 81', respectively.

The area 56'a from a point $C_1$ on the cam surface 56' clockwisely to a point $C_2$ is an arcuate area centered at the shaft 58 and having a radius $R_1$ and, during one-to-one magnification image formation mode, the pin 54 bears against some portion of this area 56'a. During $\beta$ magnification image formation mode, the pin 54 bears against a portion of the area 56'b from a point $C_3$ on the cam surface 56' clockwisely to a point $C_4$ which corresponds to the error $\Delta f$ of the focal length of the lens. The distance between the shaft 58 and the point $C_3$ is greater than the radius $R_1$ of the area 56'a, the distance between the shaft 58 and the point $C_4$ is smaller than the radius $R_1$ and the distance from the shaft 58 gradually decreases from the point $C_3$ clockwisely toward the point $C_4$. At a point $C_5$, the distance from the shaft 58 is equal to the radius $R_1$ of the area 56'a.

The area 81'a from a point $C_{11}$ on the cam surface 81' clockwisely to a point $C_{12}$ is an arcuate area centered at the shaft 58 and having a radius $R_2$ and, during one-to-one magnification image formation mode, the pin 82 bears against some portion of this area 81'a. During $\beta$ magnification image formation mode, the pin 82 bears against a portion of the area 81'b from a point $C_{13}$ on the cam surface 81' clockwisely to a point $C_{14}$ which corresponds to the error $\Delta f$ of the focal length of the lens. The distance between a point $C_{15}$ in the area 81'b (the point $C_{15}$, the shaft 58 and the point $C_5$ lie on a straight line and the shaft 58 lie between the points $C_{15}$ and $C_5$) and the shaft 58 is $R_3$. The distance between the point $C_{13}$ and the shaft 58 is greater than $R_3$, the distance between the point $C_{14}$ and the shaft 58 is smaller than $R_3$ and the distance from the shaft 58 gradually decreases from the point $C_{13}$ clockwisely toward the point $C_{14}$. $R_3$ is determined in accordance with the following equation:

$$R_3 - R_2 = L_2/2$$

Attention is now paid to an arbitrary point $C_6$ in the area 56'b of the cam surface 56'. The pin 54 bears against this point $C_6$ during $\beta$ magnification image formation mode when the error $\Delta f$ of the focal length of the lens is $\Delta f_1$. Assuming that the distance between the point $C_6$ and the shaft 58 is $R_4$, $R_4$ is determined by the following equation:

$$R_1 - R_4 = (\beta - 1)\Delta f_1$$

The right side of the above equation is the value of the aforementioned $\Delta L_3$ when $\Delta f$ is $\Delta f_1$.

Attention is also paid to a point $C_{16}$ in the area 81'b of the cam surface 81'. The point $C_{16}$, the shaft 58 and the point $C_6$ are arranged on a straight line. Accordingly, in the present embodiment wherein the pins 53, 82 and the shaft 58 are arranged on a straight line as previously described, the pin 82 bears against the point $C_{16}$ when the pin 54 bears against the point $C_6$. Assuming that the distance between the point $C_{16}$ and the shaft 58 is $R_5$, $R_5$ is is determined in accordance with the following equation:

$$R_3 - R_5 = \frac{(1-\beta)^2}{2\beta}\Delta f_1$$

The right side of the above equation is the value of $\frac{1}{2}$ of the aforementioned $\Delta L_4$ when $\Delta f$ is $\Delta f_1$.

As is apparent from the foregoing, the area 56'b of the cam surface 56' is for correcting the position of the lens 16 during $\beta$ magnification image formation mode correspondingly to the error of the focal length of the lens, and the area 81'b of the cam surface 81' is for correcting the positions of the mirrors 14 and 15 during $\beta$ magnification image formation mode correspondingly to the error of the focal length of the lens. Thus, where there is not the error in the focal length of the lens, during one-to-one magnification image formation mode, the pin 54 bears against the point $C_7$ and the pin 82 bears against the point $C_{17}$ and, during $\beta$ magnification image formation mode, the pin 54 bears against the point $C_5$ and the pin 82 bears against the point $C_{15}$. (The point $C_{17}$, the point $C_5$, the shaft 58, the point $C_7$ and the point $C_{15}$ are arranged on a straight line.) In other words, the fixed phase angle of the cam plate 55 relative to the shaft 58 is adjusted so that what has been described above may be achieved. Also, where there is the error $\Delta f_1$ in the focal length of the lens, during one-to-one magnification image formation mode, the pin 54 bears against the point $C_8$ and the pin 82 bears against the point $C_{18}$ and, during $\beta$ magnification image formation mode, the pin 54 bears against the point $C_6$ and the pin 82 bears against the point $C_{16}$. (The point $C_{18}$, the point $C_6$, the shaft 58 and the point $C_8$ are arranged on a straight line.) In other words, the fixed phase angle of the cam plate 55 relative to the shaft 58 is adjusted so that what has been described above may be achieved.

In the present embodiment, the point $C_{11}$, the point $C_3$, the shaft 58, the point $C_1$ and the point $C_{13}$ as well as the point $C_{12}$, the point $C_4$, the shaft 58, the point $C_2$ and the point $C_{14}$ are arranged on a straight line.

Now, in the device of FIG. 11, the lens position adjustment for one-to-one magnification image formation mode is effected similarly to that in the device of FIG. 2. During the lens position adjustment for one-to-one magnification image formation mode, the pin 82 bears against the area 81'a of the cam 81 and therefore, at this time, the second mirror bed 79 lies at its position for one-to-one magnification image formation mode. In this condition, the screw 78 is loosened and the mirrors 14 and 15 are moved and adjusted in a direction parallel to the rail 33 relative to the second mirror bed 79. When, by both said mirror adjustment and said lens adjustment, the lens 16 and the mirrors 14, 15 have been brought to their positions in which a focused one-to-one magnification image of the original can be formed on the photosensitive medium P, the screws 28 and 78 are tightened to fix the lens 16 and the mirrors 14, 15 to the lens bed 25 and the second mirror bed 79, respectively. The fixed positions of the lens 16 and the mirrors 14, 15 on the lens bed 25 and the second mirror bed 79 brought about by said adjustments correspond to the error of the focal length of the lens 16. That is, the position of the lens 16 when $\Delta f$ is not 0 is displaced on the lens bed 25 in the lengthwise direction of the rail 33 by the distance $\Delta L_1$ (see FIG. 10) from the position of the lens when $\Delta f$ is 0. Also, the positions of the mirrors 14, 15 when $\Delta f$ is not 0 are displaced on the second mirror bed 79 in the lengthwise direction of the rail 33 by the distance $\Delta L_2/2$ (see FIG. 10) from the positions of the mirrors 14, 15 when $\Delta f$ is 0. The direction of said displacement is the direction toward the photosensitive medium when $\Delta f$ is negative, and is the direction away from the photosensitive medium when $\Delta f$ is positive.

The method of adjusting the positions of the lens 16 and mirrors 14, 15 during $\beta$ magnification image formation mode is similar to the adjusting method of FIG. 2 except that in the device of FIG. 11, the mirrors 14, 15 are automatically displaced if the cam plate 55 is rotated. That is, a nut 59 is loosened to render the cam plate 55 rotatable relative to the shaft 58 and at the same time a stopper 42 is brought into engagement with a cut-away 41. Thus, with the shaft 58 being fixed, the cam plate 55 is rotated to a position in which the area 56'b of the cam surface 56' bears against the pin 54 and accordingly the area 81'b of the cam surface 81 bears against the pin 82. Further, the cam plate 55 is rotatively adjusted relative to the shaft 58 within a range in which the pins 54 and 82 been against the areas 56'b and 81'b, respectively, whereby the positions of the lens 16 and mirrors 14, 15 with respect to a direction parallel to the lengthwise direction of the rail 33 are adjusted. When, by this adjustment, the lens 16 and mirrors 14, 15 are brought to positions in which a focused $\beta$ magnification image of the original can be formed on the photosensitive medium P, the nut 59 is tightened to fix the cam plate 55 to the shaft 58. By this, the position of the stopper 42 and accordingly the position of the lens bed 25 and of the second mirror bed 79 is set. In other words, the position of the lens 16 and the positions of the mirrors 14 and 15 during $\beta$ magnification image formation mode are determined correspondingly to the presence and magnitude of the error of the focal length of the lens. That is, in this condition, the pins 54 and 82, as previously described, bear against the portions of the areas 56'b and 81'b of the cam surfaces 56' and 81', respectively, which correspond to the error $\Delta f$ of the focal length of the lens.

After the positions at which the pins 54 and 82 bear against the slot cams 56 and 81 during $\beta$ magnification image formation mode have been set in the manner described above, the cam plate 55 is caused to make one-half rotation during magnification changing operation. Thereby the stopper 42 and the mirrors 14, 15 fixed to the second mirror bed 74 are moved by an amount adjusted correspondingly to the error of the focal length of the lens.

In the previously described example, the fixed angular position of the cam plate 55 relative to the shaft 58 during $\beta$ magnification image formation mode has been obtained by moving the lens 16 and the stopper 42 at a time with the stopper 42 being fitted in the cut-away 41, whereas an adjusting method may also be adopted which comprises rotating pulleys 36 and 37 to move the lens bed 25 without the stopper 42 being engaged with any of cut-aways 40 and 41, thereby bringing the lens 16 to a position corresponding to $\Delta f$ in which a focused $\beta$ magnification image of the original can be formed on the photosensitive medium P, and thereafter rotating the cam plate 55 relative to the shaft 58 to move the stopper 42 to a position in which it is engageable with the cut-away 41, and then fixing the cam plate 55 to the shaft 58. At this time, by the action of the slot cam 81, the mirrors 14 and 15 are automatically brought to their positions in which a focused $\beta$ magnification image of the original can be formed on the photosensitive medium P. Adjustment of the fixed position of the lens 16 relative to the lens bed 25 and adjustment of the fixed positions of the mirrors 14 and 15 relative to the mirror bed 79 may be carried out during the adjustment for $\beta$ magnification image formation mode.

The amount of movement of the lens during magnification change is usually greater than the amount of movement of the mirrors and therefore, in the above-described example, the mirrors 14 and 15 have been moved by a cam 81, the lens 16 has been moved by pulleys 36, 37 and wire 34, and the correction of the amount of movement of the lens 16 corresponding to $\Delta f$ has been carried out by the use of the cam 56. However, alternatively, the mirrors 14 and 15 may be moved by a pulley-wire mechanism such as the aforementioned pulleys 36, 37 and wire 34 and the lens 16 may be moved by a cam mechanism such as the aforementioned cam 81. In this case, the correction of the amounts of movement of the mirrors 14, 15 corresponding to $\Delta f$ may be carried out by a mechanism such as a stop position correcting mechanism comprising the aforementioned positioning plate 39, stopper 42, cam 56, etc.

In the above-described example, the correction of the amounts of movement of the lens and mirrors corresponding to $\Delta f$ is carried out by the adjustment of the fixed angular position of the single cam 55 relative to the shaft 58 and therefore, said correction can be accomplished easily and accurately.

Figure 13:
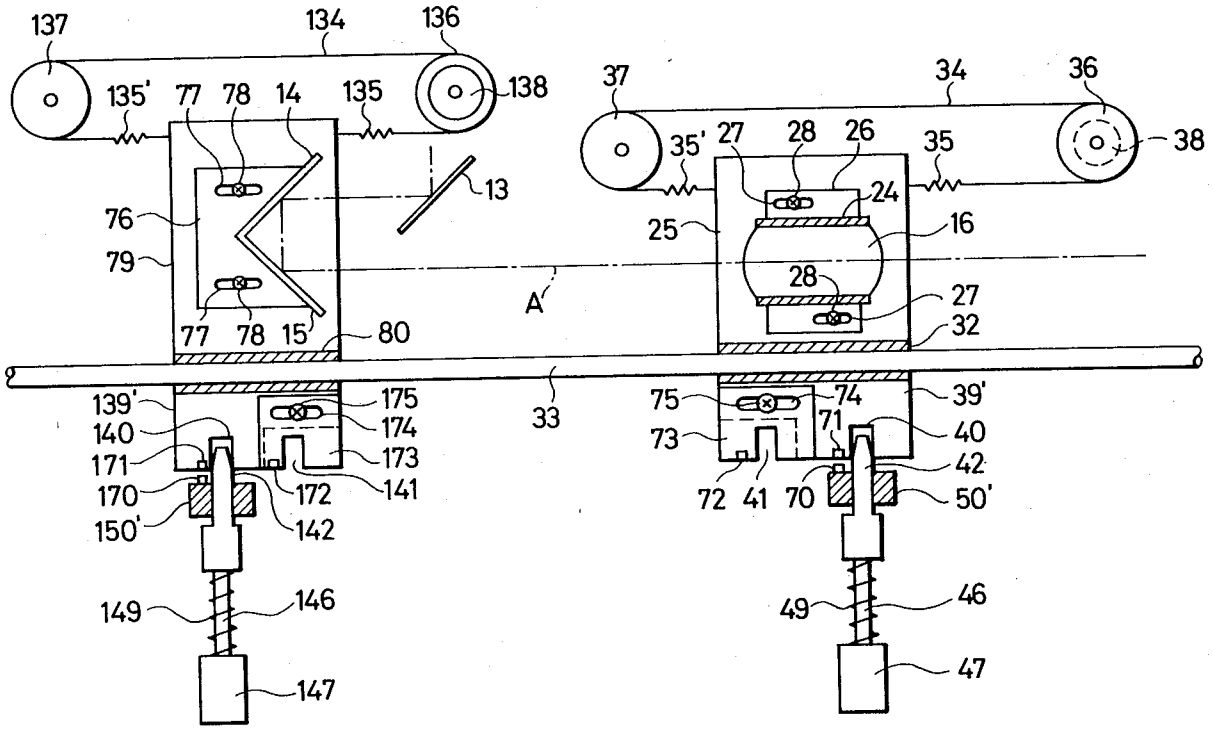
FIG. 13 illustrates a further embodiment of the present invention.

Reference is now had to FIG. 13 to describe an embodiment in which the correction of the amounts of movement of the lens and mirrors can be accomplished by a simple mechanism. In FIG. 13, a mechanism similar to that described in connection with FIG. 4 is used for the correction of the amount of movement of the lens 16. The only difference between the mechanism of FIG. 4 and the mechanism of FIG. 13 is that in FIG. 4, the magnet 70 is mounted on the stopper 42, whereas in FIG. 13, the magnet 70 is mounted on a stopper guide 50'. This stopper guide 50' is fixed at the position shown. Also, in FIG. 13, movement of the mirrors 14 and 15 and correction of the amounts of movement thereof are accomplished by a mechanism similar to the mechanism for moving the lens and correcting the amount of movement thereof. Those of the members and means of the mirror moving mechanism and the mechanism for correcting the amounts of movement of the mirrors which are functionally similar to the members and means of the lens moving mechanism and the mechanism for correcting the amount of movement of the lens are given reference numerals of the latter plus 100 and the description thereof will be omitted to avoid cumbersomeness of description.

Now, in the device of FIG. 13, the adjustment of the positions of the lens 16 and mirrors 14 and 15 for one-to-one magnification image formation mode is accomplished in the following manner.

Stoppers 42, 142 are first brought into engagement with cut-aways 40, 140 of positioning plates 39', 139' fixed to the lens bed 25 and the second mirror bed 79, respectively, and the lens bed 25 and the second irror bed 79 are held stationary at their positions for one-to-one magnification image formation mode.

Screws 28 and 78 are then loosened and the lens 16 and mirrors 14, 15 are moved and adjusted in a direction parallel to the lengthwise direction of the rail 33 relative to the beds 25 and 79 on which the lens and mirrors are stationarily held, whereby the lens 16 and mirrors 14, 15 are brought to positions in which a focused one-to-one magnification image of the original can be formed on the photosensitive medium P and at the stage whereat the respective positions have been obtained, the screws 28 and 78 are tightened to fix the lens 16 and mirrors 14, 15 to the beds 25 and 79, respectively. As is apparent from what has been previously described, the positions of the lens 16 and mirrors 14, 15 on the beds 25 and 79 obtained by said adjustment correspond to the error of the focal length of the lens.

Screws 75 and 175 are then loosened to render plate pieces 73 and 173 movable relative to plates 39' and 139'. On the other hand, the stoppers 42 and 142 are retracted to positions in which they do not engage cut-aways 40, 140 and 41, 141, respectively, and the beds 25 and 79 are rendered movable along the rail 33. The beds 25 and 79 are moved, whereby the lens 16 and mirrors 14, 15 are brought to positions in which a focused $\beta$ magnification image of the original can be formed on the photosensitive medium P. The then positions of the lens 16 and mirrors 14, 15 correspond to $\Delta f$, as previously described. The plate pieces 73 and 173 are moved and adjusted in said direction relative to plates 39' and 139' with the beds 25 and 79 held at their respective positions, and are brought to positions in which the cut-aways 41 and 141 are engageable with the stoppers 42 and 142, respectively. When the cut-aways 41 and 141 have come to the positions in which they are engageable with the stoppers 42 and 142, respectively, screws 74 and 174 are tightened to fix the plate pieces 73 and 173 to the plates 39' and 139', respectively. The spacing between the cut-aways 40 and 41 obtained by this adjustment is equal to the aforementioned $L_3$, and the spacing between the cut-aways 140 and 141 is equal to the aforementioned $L_4$. In other words, the amount of movement of the lens 16 and the amounts of movement of the mirrors 14 and 15 during magnification changing operation are corrected correspondingly to $\Delta f$ by the adjustment of the spacing between the cut-aways 40 and 41 and the adjustment of the spacing between the cut-aways 140 and 141.

The operating mode of the FIG. 13 device during magnification change is as follows. Where the mode is to be changed from one-to-one magnification image formation mode to $\beta$ magnification image formation mode, when a magnification changing switch is closed, solenoids 47 and 147 are operated to retract the stoppers 42 and 142 from the cut-aways 40 and 140, and then motors 38 and 138 rotate in forward direction to move the bed 25 upwardly rightwardly and the bed 79 upwardly leftwardly, as viewed in FIG. 13. At a point of time whereat the beds 25 and 79 have been moved to positions in which elements 72 and 172 become opposed to magnets 70 and 170, respectively, the elements 72 and 172 form said signals and the motors 38 and 138 are deenergized to stop the movement of the beds 25 and 79 while, at the same time, the solenoids 47 and 147 are deenergized and the stoppers 42 and 142 come into engagement with the cut-aways 41 and 141, respectively. Thus, the lens 16 and mirrors 14, 15 are held at their respective positions corresponding to $\Delta f$ during $\beta$ magnification image formation mode. On the other hand, where the mode is to be changed from $\beta$ magnification image formation mode to one-to-one magnification image formation mode, when the magnification changing switch is closed, the solenoids 47 and 147 are operated and the stoppers 42 and 142 retract from the cut-aways 41 and 141, and then the motors 38 and 138 rotate in reverse direction to move the bed 25 upwardly leftwardly and the bed 79 upwardly rightwardly, as viewed in FIG. 13. At a point of time whereat the beds 25 and 79 have been moved to positions in which elements 71 and 171 become opposed to the magnets 70 and 170, respectively, the elements 71 and 171 form said signals and the motors 38 and 138 are deenergized to stop the movement of the beds 25 and 79 while, at the same time, the solenoids 47 and 147 are also deenergized and the stoppers 42 and 142 come into engagement with the cut-aways 40 and 140, respectively. Thus, the lens 16 and mirrors 14, 15 are held at their respective positions corresponding to Δf during one-to-one magnification image formation mode.

As will be seen from what has been previously described, the beds 25 and 79 are held at the same positions during one-to-one magnification image formation mode irrespective of the presence and magnitude of the error of the focal length of the lens. (However, the lens 16 and mirrors 14, 15 also lie at positions corresponding to Δf during one-to-one magnification image formation mode), but lie at positions corresponding to Δf during $\beta$ magnification image formation mode.

Figure 14:
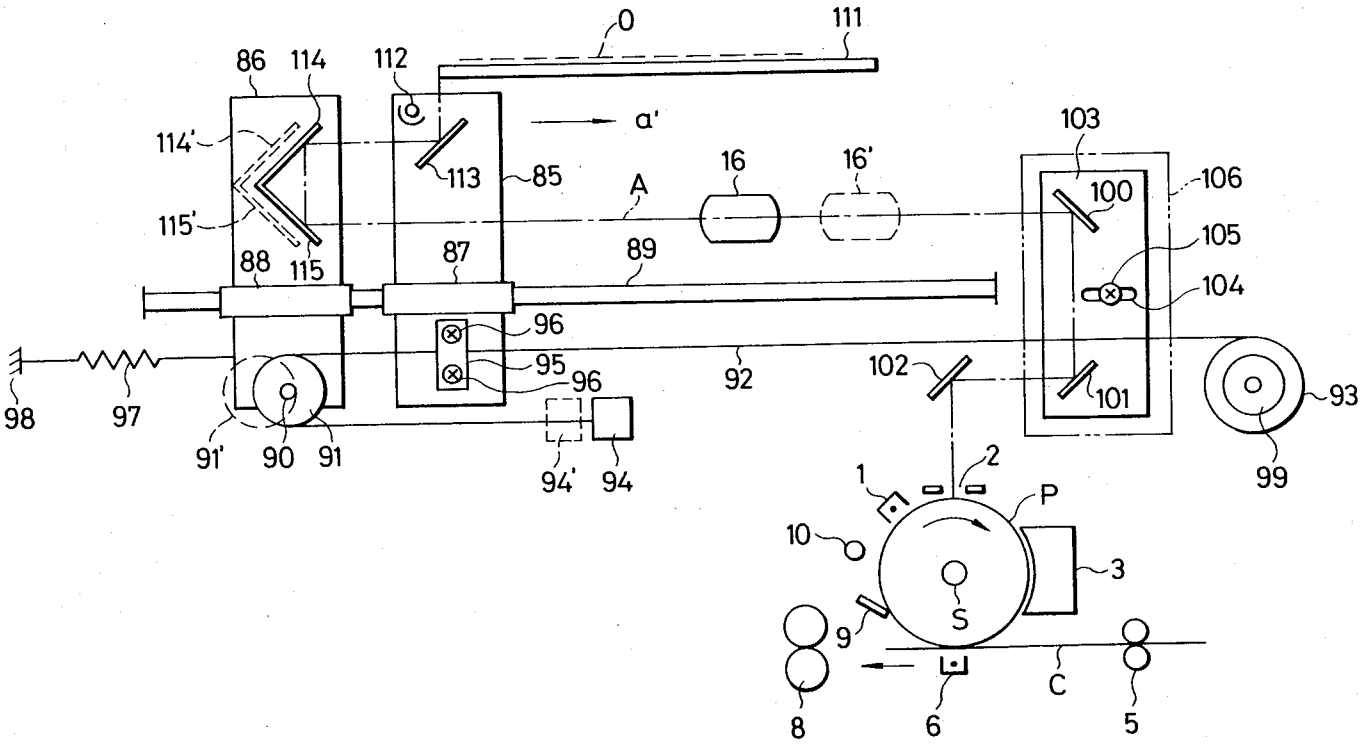
FIG. 14 illustrates still another embodiment of the present invention.

Referring now to FIG. 14, its shows an example in which the present invention is applied to a system wherein the original is scanned with the original supporting table remaining stationary and the mirrors being moved. In the following embodiment, the correction of the length of optical path for forming a one-to-one magnification image of the original in a focused state may be accomplished by adjusting the positions of mirrors which are not designed to be moved during magnification changing operation.

In FIG. 14, members and means functionally similar to those of the previous embodiment are given similar reference characters and description thereof is omitted unless specifically required. In FIG. 14, reference numeral 111 designates an original supporting table fixed in place. An original O to be copied is stationarily held on the original supporting table 111. Designated by 113 is a first scanning mirror disposed at an angle of 45° with respect to the surface of the original. Reference numerals 114 and 115 denote mirrors constituting a second scanning mirror structure and disposed in orthogonal relationship with each other, the mirror 114 being parallel to the mirror 113. Denoted by 112 is an original illuminating lamp. The mirror 113 and the lamp 112 are fixed to a first movable mirror bed (first mirror carriage) 85, and the mirrors 114 and 115 are fixed to a second movable mirror bed (second mirror carriage) 86. Slide bearings 87 and 88 are fixed to the beds 85 and 86, respectively. These bearings 87 and 88 are fitted on a guide rail 89 for sliding movement lengthwisely thereof, the guide rail 89 being elongated in a direction parallel to the original supporting table 111.

A pulley 91 is rotatably supported on a shaft 90 studded in the second movable mirror bed 86. Wire 92 is passed over the pulley 91. One end of the wire 92 is secured to a drive pulley 93 rotatable in a predetermined position and the other end is secured to a wire fixing plate 94 movably supported on a guide rail (not shown) elongated in a direction parallel to the surface of the original like the guide rail 33 and accordingly movable in a direction parallel to the original supporting table. This plate 94 is moved during magnification changing operation, but is held stationary during copying operation in which the image of the original is formed on the photosensitive medium P. Between the pulleys 91 and 93, the wire 92 is fixed to the first movable mirror bed 85 by a wire keep plate 95. The wire keep plate 95 is fixed to the bed 85 by a screw 96 threaded into the bed 85, thereby pressing and fixing the wire 92 to the bed 85. Accordingly, if the screw 96 is loosened, the fixed position of the bed 85 and thus of the mirror 112 relative to the wire 92 can be adjusted.

A tension spring 97 has one end thereof secured to the second movable mirror bed 86 and the other end thereof secured to an immovable member 98 within the copying apparatus body. This spring is expanded to store its resilient force when the bed 86 is moved rightwardly as viewed in FIG. 14. Designated by 99 is a motor. The pulley 93 is connected to the output shaft of the motor 99. When a copying operation at a selected magnification is entered, the motor 99 is operated to rotatively drive the pulley 93 clockwisely. Thus, the beds 85 and 86 move forward in the direction of arrow parallel to the original supporting table at a velocity ratio of $1:\frac{1}{2}$ while expanding the spring 97. Accordingly, the mirrors 114 and 115 move forward in the direction of arrow a' at a velocity ratio of $1:\frac{1}{2}$ to thereby scan the original.

It is for the purpose of maintaining the length of the optical path between the original and the lens at a length set correspondingly to a selected magnification during original scanning that the mirror 113 and mirrors 114, 115 are moved parallel to the original supporting table 111 at the velocity ratio of $1:\frac{1}{2}$. Also, the relation between the forward movement velocity (original scanning speed ) $V_1$ of the mirror 113 and the peripheral velocity $V_2$ of the photosensitive medium P is determined in accordance with the equation $V_2/V_1=m$ so that the magnification of the copy image with respect to the direction of rotation of the drum P may be coincident with a selected magnification. Means for setting such velocity ratio is well known.

When the original scanning is terminated, the motor 99 is deenergized and by the resilient force of the spring 97, the mirror 113 and mirrors 114, 115 are moved backwardly in the direction opposite to the direction of arrow at a velocity ratio of $1:\frac{1}{2}$ and return to their respective forward movement starting positions. As will hereinafter be described, the forward movement starting position of the second movable mirror held 86 is changed correspondingly to a magnification selected by magnification changing operation. That is, the forward movement starting positions of the mirrors 114, 115 during one-to-one magnification image formation mode are the solid line positions shown in FIG. 14, and the forward movement starting positions of the same mirrors during $\beta$ magnification formation mode are the broken line positions 114' and 115' shown in FIG. 14. However, the forward movement starting positions of the mirrors 114 and 115 and accordingly the forward movement starting position of the bed 86, during $\beta$ magnification image formation mode, are corrected correspondingly to the error of the focal length of the lens. On the other hand, in the present embodiment, the forward movement starting position of the mirror 113 and accordingly of the bed 85 is the same during both one-to-one magnification image formation mode and $\beta$ magnification image formation mode. However, during the assembly or repair of the apparatus, the forward movement starting position of the mirror 113 and accordingly of the bed 85 is corrected correspondingly to the error $\Delta f$ of the focal length of the lens by loosening the screw 96, moving the bed 85 and adjusting the fixed position of the bed 85 relative to the wire 92.

Now, the light from the original scanned by the mirror 113 and mirrors 114, 115 is reflected by the mirrors 113, 114 and 115 in succession, whereafter it passes through the imaging lens 16 and is then reflected by mirrors 100, 101 and 102 in succession and enters the photosensitive drum P, thus forming an optical image of the original on the drum. The mirror 100 is parallel to the mirror 115, the mirror 101 is at right angles with the mirror 100, and the mirror 102 is parallel to the mirror 101. The optical path between the mirrors 115 and 100 is parallel to the original supporting table.

The mirrors 100, 101 and 102 are stationary mirrors which are not moved during either the original image formation on the photosensitive medium or magnification changing operation. However, the positions of the mirrors 100 and 101 are adjusted correspondingly to $\Delta f$ during the assembly or repair of the apparatus. That is, the mirrors 101 and 100 are fixed to a mirror bed 103. The mirror bed 103 has a slot 104 therein elongated in a direction parallel to the original supporting bed, and a screw 105 is fitted in this slot 104. By threading the screw 105 into an immovable member 106 of the copying apparatus body, the mirror bed 103 and accordingly the mirrors 100, 101 are fixed to the immovable member 106. The positions of the mirrors 100 and 101 can be adjusted in the same direction by loosening the screw 105 and moving and adjusting the bed 103 in parallelism to the original supporting table.

Now, the wire fixing plate 94 lies at its solid line position during one-to-one magnification image formation mode, and lies at its broken line position during $\beta$ magnification image formation mode. That is, when the plate 94 is moved leftwardly by magnification changing operation, the second movable mirror bed 86 to which the mirrors 114 and 115 are fixed is moved leftwardly by the resilient force of the spring 97 and, when the plate 94 is moved rightwardly, the mirror bed 86 is moved rightwardly by the wire 92 and pulley 91 In short, due to the principle of running block, the forward movement starting positions of the mirrors 114 and 115 are displaced by a distance of $\frac{1}{2}$ of the amount of movement of the plate 94. (The length of the optical path between the original and the photosensitive medium is varied by an amount twice as great as the amount of displacement of the forward movement starting positions of the mirrors 114 and 115.) At this time, the pulley 93 is not rotated and therefore, the first movable mirror bed 85 to which the mirror 113 is fixed is not moved. The position of the wire fixing plate 94 during one-to-one magnification image formation mode is fixed irrespective of the presence of the error of the focal length of the lens, but the position 94' during $\beta$ magnification image formation mode is corrected correspondingly to the error of the focal length of the lens. In other words, the amount of movement of the plate 94 during magnification change is corrected correspondingly to the error of the focal length of the lens. When the forward movement starting positions of the mirrors 113 and 114 are changed by movement of the plate 94, the length of the optical path between the original and the photosensitive medium is changed. The amount of movement of the wire fixing plate 94 is $(1-\beta)^2 f/\beta$ when there is not the error in the focal length of the lens, and is $(1-\beta)^2 \cdot (f+\Delta f)/\beta$ when there is the error $\Delta f$ in the focal length of the lens.

The wire fixing plate 94 is moved by a mechanism similar to the mirror moving mechanism described in connection with FIGS. 11 and 12 or 13. That is, the second mirror bed 79 is FIGS. 11 and 12 or 13 may be substituted for by the wire fixing plate 94. However, where a cam 81 is applied to the example of FIG. 14, the distance $R_3$ between the point $C_{15}$ in the area 81'b of the cam surface 81' described in connection with FIGS. 11 and 12 and the shaft 58 is determined in accordance with the following equation:

$$R_3 - R_2 = L_2$$

Also, the distance $R_5$ between the point $C_{16}$ in the cam surface area 81'b and the shaft 58 is determined in accordance with the following equation:

$$R_3 - R_5 = -\frac{(1-\beta)^2}{\beta}\Delta f_1$$

The lens 16 in the example of FIG. 14 is also moved by a mechanism similar to that described in connection with FIG. 12 or 13. However, in the case of the example of FIG. 14, positional adjustment of the mirrors 100 and 101 is effected and therefore, the screw hole 27 may be a conventional round hole and the fixed position of the lens 16 with respect to the bed 25 need not be adjusted correspondingly to $\Delta f$ as previously described. Thus, again in the example of FIG. 14, where there is not the error in the focal length of the lens, the lens 16 is moved over the distance $L_1$ by magnification changing operation and, where there is the error $\Delta f$ in the focal length of the lens, the lens 16 is moved over the distance $(L_1 - \Delta L_3)$.

The method of adjusting the position of the lens 16 and the forward movement starting positions of the mirrors 114, 115 during $\beta$ magnification image formation mode correspondingly to $\Delta f$ is similar to that described in connection with FIGS. 11 and 12 or 13.

Before the positional adjustment of the lens 16 and mirrors 114, 115 during $\beta$ magnification image formation mode is effected, adjustment of the length of the optical path during one-to-one magnification image formation mode is effected. This is carried out as follows.

In the same manner as that described previously, the lens 16 is disposed at its position for one-to-one magnification image formation mode and the mirrors 114 and 115 are disposed, for example, at their forward movement starting positions for one-to-one magnification image formation mode. Subsequently, the positions of the mirrors 113, 100 and 101 are adjusted correspondingly to the error of the focal length of the lens. That is, the screw 96 is loosened and the first movable mirror bed 85 to which the mirror 113 is fixed is moved back and forth relative to the second movable mirror bed 86 to which the mirrors 114 and 115 are fixed. By this, the length of the optical path between the original and the lens, namely, the length of the optical path on the object space side from the lens, is varied, and where the length of this optical path becomes $2(f+\Delta f)$ ($\Delta f=0$ when there is not the error in the focal length of the lens), the screw 96 is again tightened to fix the first movable mirror bed 85 to the wire 92. On the other hand, the screw 105 is loosened and the mirror bed 103 to which the mirrors 100 and 101 are fixed is moved back and forth relative to the lens 16 and the mirror 102. By this, the length of the optical path between the lens and the photosensitive medium, namely, the length of the optical path on the image space side from the lens, is varied, and where the length of this optical path becomes $2(f+\Delta f)$, the screw 105 is again tightened to fix the mirror bed 103 to an immovable member. By the above-described adjustment, the ratios of the length of the optical path between the original and the photosensitive medium to the length of the optical path between the original and the lens and to the length of the optical path between the lens and the photosensitive medium are set values for which a focused image of the original can be formed on the photosensitive medium.

If, after the correction of the length of the entire optical path during the one-to-one magnification image formation mode and the correction of the ratio of the lengths of the optical paths corresponding to $\Delta f$, the amount of movement of the lens 16 and the amounts of movement of the mirrors 114 and 115 during the change to $\beta$ magnification image formation mode are corrected correspondingly to $\Delta f$ in the described manner, a $\beta$ magnification image of the original can be formed on the photosensitive medium in a focused state during $\beta$ magnification image formation mode as well.

The positional adjustment of the mirrors 113, 100 and 101 may be effected during the adjustment of the optical system in $\beta$ magnification image formation mode.

In the example of FIG. 14, the screw hole 104 may be a conventional round hole, the mirrors 100 and 101 may be fixed in place relative to the immovable member 106 and design may be made such that the positional correction for $\Delta f$ is not effected. Alternatively, design may be made such that the adjustment of the fixed position of the first movable mirror bed 85 and accordingly of the mirror 113 relative to the wire 92 which corresponds to $\Delta f$ is not effected. In any case, as in FIGS. 11 and 13, the fixed position of the lens 16 relative to the lens bed 25 may be made adjustable by the slot 27 and screw 28.

Again in the embodiment described in connection with FIG. 14, design may be made such that after the length of the entire optical path and the ratio of the lengths of the optical paths before and behind the lens during $\beta$ magnification image formation mode have been first corrected correspondingly to $\Delta f$, the amount of movement of the lens 16 and the amounts of movement of the forward movement starting positions of the mirrors 114 and 115 when the mode is changed to one-to-one magnification image formation mode are corrected correspondingly to $\Delta f$.

Also, the technique described in connection with FIGS. 5–9 can be applied to the embodiments described in connection with FIGS. 10–14.

Although, in the above-described embodiments, 70 and 170 are magnets and 71, 72, 171 and 172 are Hall elements, 70 and 170 may be Hall elements and 71, 72, 171 and 172 may be magnets. Alternatively, 71, 72, 171 and 172 may be microswitches and 70 and 170 may be switch actuating cams, or converting 70 and 170 may be microswitches and 71, 72, 171 and 172 may be switch actuating cams.

In the above-described embodiments, a copy apparatus has been exemplified in which two modes such as one-to-one magnification image formation mode and $\beta$ magnification image formation mode can be selected, but the present invention is also applicable to an apparatus in which three or more different magnifications can be selected, and is also applicable to an apparatus in which enlarged image formation mode can be selected.

In the above-described examples, the positions of the mirrors 14, 15, 114 and 115 on the object space side have been changed to change the length of the optical path between the original and the photosensitive medium so as to correspond to a selected magnification, but design may also be made such that the mirrors 17, 100 and 101 on the image space side are moved to positions corresponding to a selected magnification to change the length of the entire optical path.

Although, in the previously described example, a lens having a fixed focal length has been used as the lens, the present invention is also applicable to an apparatus using a lens having a variable focal length such as a zoom lens. In that case, the mirrors need not be moved during magnification changing operation. That is, the length of the optical path between the original and the photosensitive medium need not be changed even during magnification changing operation, but the length of the entire optical path may be maintained constant for copying mode of any magnification.

While, in each of the previously described embodiment, the mirrors have been parallel-moved in a direction parallel to the optical axis of the lens, the mirrors may be parallel-moved or rotatively moved in a direction inclined with respect to the optical axis of the lens to change or correct the length of the optical path.

Further, the present invention is also applicable to an apparatus having a so-called original feeding device for moving an original by means of a roller or a belt to scan the original or an apparatus of the type in which the lens is moved to scan an original.

The present invention is further applicable not only to an apparatus of the type in which an original is scanned and optically projected onto a photosensitive medium but also to an apparatus of the type in which an original is illuminated by a flash lamp or the like and the image of the entire surface of an original is projected onto a photosensitive medium at a time.

Furthermore, the present invention is also applicable to an image processing apparatus in which CCD (charge coupled device) is used as a photosensitive medium and the information of an optical image is once converted into an electrical signal, which is used to form a desired visible image.

We claim:

1. A variable magnification optical apparatus in which at least a first magnification image formation mode and a second magnification image formation mode can be selected, said apparatus including:

illuminating means for illuminating an original;

a photosensitive medium;

a lens for forming an image of the original on said photosensitive medium;

a movable carriage for supporting said lens;

guide means for guiding said lens carriage along a path having as a direction component a least a direction parallel to the optical axis of said lens;

carriage moving means for moving said lens carriage along said path to change the image formation mode; and correction means for correcting the distance over which said lens carriage is moved by said carriage moving means correspondingly to an error of the focal length of said lens, said correction means including:

a stopper member for stopping said lens carriage; and stopper position correcting means for moving said stopper member over a distance corresponding to the error of the focal length of said lens during an image formation mode hanging operation, said stopper position correcting means keeping the position of said stopper member at the same position relative to the first magnification image formation mode or to the second magnification image formation mode when the error of the focal length of said lens is zero.

2. The apparatus according to claim 1, wherein said stopper position correcting means includes:

a cam member for moving said stopper member in a direction along the movement path of said lens carriage;

cam driving means for driving said cam member during an image formation mode change; and adjusting means for adjusting the mounted position relationship of said cam member relative to said cam driving means correspondingly to the error of the focal length of said lens.

3. The apparatus according to claim 1, wherein said correction means further includes:

stopper driving means for moving said stopper member into and out of the movement path of said lens carriage during an image formation mode changing operation; and lens position detecting means for detecting the position of said lens to control said stopper member position changing means and said stopper driving means, said detecting means having a first portion moved over a distance corresponding to the error of the focal length of said lens by said stopper member position changing means during an image formation mode changing operation and a second portion fixed to said lens carriage.

4. A variable magnification optical apparatus in which at least a first magnification image formation mode and a second magnification image formation mode can be selected, said apparatus including:

illuminating means for illuminating an original;

a photosensitive medium;

an optical system for forming an image of the original on said photosensitive medium, said optical system having a mirror and a lens;

lens moving means for moving said lens to change the image formation mode;

mirror moving means for moving said mirror to change the image formation mode;

first correction means for correcting the distance over which said lens is moved by said lens moving means correspondingly to an error of the focal length of said lens; and second correction means for correcting the distance over which said mirror is moved by said mirror moving means correspondingly to the error of the focal length of said lens.

5. A variable magnification optical apparatus according to claim 4, wherein said first correction means and said second correction means are operatively connected.

6. A variable magnification optical apparatus in which at least a first magnification image formation mode and a second magnification image formation mode can be selected, said apparatus including:

illuminating means for illuminating an original;

a photosensitive medium;

a lens for forming an image of the original on said photosensitive medium;

a movable carriage for supporting said lens;

guide means for guiding said lens carriage along a path having as a direction component at least a direction parallel to the optical axis of said lens;

carriage moving means for moving said lens carriage along said path to change the image formation mode; and correction means for correcting the distance over which said lens carriage is moved by said carriage moving means correspondingly to an error of the focal length of said lens, said correction means including:

a stopper member for stopping said lens carriage;

first and second engaging portions provided on said lens carriage, said stopper member being engaged with said first engaging portion during the first magnification image formation mode and being engaged with said second engaging portion during the second magnification image formation mode; and adjusting means for adjusting the spacing between said first and said second engaging portion correspondingly to the error of the focal length of said lens.

7. The apparatus according to claim 6, wherein said correction means further includes:

stopper driving means for moving said stopper member into and out of the movement path of said lens carriage during an image formation mode changing operation; and lens position detecting means for detecting the position of said lens and controlling said stopper driving means, said detecting means having a first portion provided in place, and a second and a third portion mounted on said carriage with the spacing therebetween being adjustable correspondingly to the error of the focal length of said lens, said second portion corresponding to said first engaging portion and said third portion corresponding to said second engaging portion.

8. The apparatus according to claims 1, 2, 3, 6 or 7 further including:

means for adjusting the supported position of said lens relative to said lens carriage correspondingly to the error of the focal length of said lens.

9. A variable magnification optical apparatus in which at least a first magnification image formation mode and a second magnification image formation mode can be selected, said apparatus including:

a photosensitive medium;

an optical system for forming an image of an original on said photosensitive medium, said optical system having a mirror and a lens;

a lens carriage for supporting said lens;

a mirror carriage for supporting said mirror;

lens carriage moving means for moving said lens carriage along a first path having as a direction component at least a direction parallel to the optical axis of said lens to change the image formation mode;

mirror carriage moving means for moving said mirror carriage along a second path having as a direction component at least a direction parallel to the optical axis of said lens to change the image formation mode;

lens carriage movement amount correction means for correcting the distance over which said lens carriage is moved by said lens carriage moving means correspondingly to an error of the focal length of said lens; and mirror carriage movement amount correction means for correcting the distance over which said mirror carriage is moved correspondingly to the error of the focal length of said lens;

wherein said lens carriage movement amount correction means includes:

a first stopper member for stopping said lens carriage;

a first and a second engaging portion provided on said lens carriage, said first stopper member being engaged with said first engaging portion during the first magnification image formation mode and being engaged with said second engaging portion during the second magnification image formation mode; and adjusting means for adjusting the spacing between said first and second engaging portion correspondingly to the error of the focal length of said lens; and wherein said mirror carriage movement amount correction means includes:

a second stopper member for stopping said mirror carriage;

a third and a fourth engaging portion provided on said mirror carriage, said second stopper member being engaged with said third engaging portion during the first magnification image formation mode and being engaged with said fourth engaging portion during the second magnification image formation mode; and adjusting means for adjusting the spacing between said third and said fourth engaging portion correspondingly to the error of the focal length of said lens.

10. The apparatus according to claim 9, wherein said lens carriage movement amount correction means further includes:

stopper driving means for moving said first stopper member into and out of the movement path of said lens carriage during an image formation mode changing operation; and lens position detecting means for detecting the position of said lens and controlling said stopper during means, said detecting means having a first portion provided in place, and a second and a third portion mounted on said lens carriage with the spacing therebetween being adjustable correspondingly to the error of the focal length of said lens, said second portion corresponding to said first engaging portion and said third portion corresponding to said second engaging portion.

11. The apparatus according to claim 9, wherein said mirror carriage movement amount correction means further includes:

stopper driving means for moving said second stopper member into and out of the movement path of said mirror carriage during an image formation mode changing operation; and mirror position detecting means for detecting the position of said mirror and controlling said stopper driving means, said detecting means having a first portion provided in place, and a second and a third portion mounted on said mirror carriage with the spacing therebetween being adjustable correspondingly to the error of the focal length of said lens, said second portion corresponding to said third engaging portion and said third portion corresponding to said fourth engaging portion.

12. A variable magnification optical apparatus in which at least a first magnification image formation mode and a second magnification image formation mode can be selected, said apparatus including:

a photosensitive medium;

an optical system for forming an image of an original on said photosensitive medium, said optical system having a mirror and a lens;

a first carriage for supporting one of said mirror and lens;

a second carriage for supporting the other of said mirror and lens;

first carriage moving means for moving said first carriage along a first path having as a direction component at least a direction parallel to the optical axis of said lens to change the image formation mode;

second carriage moving means for moving said second carriage along a second path having as a direction component at least a direction parallel to the optical axis of said lens to change the image formation mode;

first carriage movement amount correction means for correcting the distance over which said first carriage is moved by said first carriage moving means correspondingly to an error of the focal length of said lens; and second carriage movement amount correction means for correcting the distance over which said second carriage is moved correspondingly to the error of the focal length of said lens;

said first carriage movement amount correction means including:

a stopper member for stopping said first carriage;

stopper position correction means for moving said stopper member over a distance corresponding to the error of the focal length of said lens during an image formation mode changing operation, said stopper position correcting means being operatively associated with said second carriage moving means;

stopper driving means for moving said stopper member into and out of the movement path of said first carriage during image formation mode changing operation; and first carriage position detecting means for detecting the position of said first carriage and controlling said stopper member position changing means and said stopper driving means, said detecting means having a first portion moved over a distance corresponding to the error of the focal length of said lens by said stopper member position changing means, and a second portion fixed to said first carriage.

13. A variable magnification optical apparatus in which at least a first magnification image formation mode and a second magnification image formation mode can be selected, said apparatus including:

a photosensitive medium;

an optical system for forming an image of an original on said photosensitive medium, said optical system having a mirror and a lens;

a first carriage for supporting one of said mirror and lens;

a mirror carriage for supporting other of said mirror and lens;

first carriage moving means for moving said first carriage along a first path having as a direction component at least a direction parallel to the optical axis of said lens to change the image formation mode;

a stopper member for stopping said first carriage;

stopper position correction means for moving said stopper member over a distance corresponding to the error of the focal length of said lens during an image formation mode changing operation, said stopper position correcting means having a first cam for moving said stopper member along said first path;

second carriage moving means for moving said second carriage along a second path having as a direction component at least a direction parallel to the optical axis of said lens to change the image formation mode, said second carriage moving means having a second cam for moving said second carriage along said second path, said second cam having a cam portion for correcting the distance over which said second carriage is moved correspondingly to the error of the focal length of said lens, and said first cam and said second cam being provided on the same cam member;

cam driving means for driving said cam member during image formation mode change; and adjusting means for adjusting the mounted position relationship of said cam member to said cam driving means correspondingly to the error of the focal length of said lens.

14. The apparatus according to claim 9, 12, 13, 10 or 11 further including:

means for adjusting the mounted position of said lens relative to said lens carriage correspondingly to the error of the focal length of said lens.

15. The apparatus according to claim 9, 12, 13, 10 or 11 further including:

means for adjusting the mounted position of said mirror relative to said mirror carriage correspondingly to the error of the focal length of said lens.

16. A variable magnification optical apparatus in which at least a first magnification image formation mode and a second magnification image formation mode can be selected, said apparatus including:

original supporting means for supporting an original, said supporting means having a reference line to which a side edge of the original is registered, said reference line being commonly used during both the first magnification image formation mode and the second magnification image formation mode;

a photosensitive medium;

a lens for forming an image of the original on said photosensitive medium;

lens moving means for moving said lens to change the image formation mode, said lens moving means moving said lens along a path having as direction components a first direction for changing the magnification of the image of the original and a second direction for forming an image of said side edge of the original on a predetermined side edge portion of said photosensitive medium; and correction means for correcting both the distance over which said lens is moved in the first direction by said lens moving means correspondingly to the error of the focal length of said lens, and the distance over which said lens is moved in the second direction by said lens moving means correspondingly to the error of the focal length of said lens.

17. The apparatus according to claim 16, further including:

a movable carriage for supporting said lens; and guide means for guiding said movable carriage along said path;

wherein said correcting means includes means for adjusting the position of said guide means with respect to said second direction.

18. The apparatus according to claim 17, wherein said guide means is a cam which has a first cam surface corresponding to the first magnification image formation mode and a second cam surface corresponding to the second magnification image formation mode, said first cam surface and said second cam surface being straight and parallel to each other.

19. The apparatus according to claim 16, further including:

a movable carriage for supporting said lens; and guide means for guiding said movable carriage along said path;

wherein said correcting means includes means for adjusting the inclination of at least a portion of said guide means with respect to said first direction.

20. The apparatus according to claim 19, wherein said guide means is a cam which has a first cam surface corresponding to the first magnification image formation mode, and a second cam surface corresponding to the second magnification image formation mode, and said adjusting means is to adjust the inclination of said second cam surface relative to said first cam surface.

21. The apparatus according to any one of claims 17 to 20, further including:

means for adjusting the supported position of sand lens relative to said movable carriage correspondingly to the error of the focal length of said lens.

22. A variable magnification optical apparatus in which at least a first magnification image formation mode and a second magnification image formation mode can be selected, said apparatus including:

original supported means for supporting an original, said supporting means having a reference line to which a side edge of the original is registered, said reference line being commonly used during both the first magnification image formation mode and the second magnification image formation mode;

a photosensitive medium;

a lens for forming an image of the original on said photosensitive medium;

a first movable carriage for fixing said lens thereto;

a second movable carriage for supporting said first movable carriage;

first guide means for guiding said first carriage on said second carriage for movement in a first direction relative to said second carriage, the position of a side edge of the image of the original being adjusted at a side edge portion of said photosensitive medium by movement of said first carriage in said first direction;

second guide means for guiding said second carriage in a second direction which is a direction intersecting said first direction and which has as a direction component a direction parallel to the optical axis of said lens;

a cam member for guiding said first carriage along a path inclined with respect to both said first direction and said second direction during movement of said second carriage;

second carriage driving means for moving said second carriage in said second direction to change the image formation mode;

said first carriage being moved along said path in response to the movement of said second carriage;

correction means for correcting the distance over which said second carriage is moved by said second carriage driving means correspondingly to an error of the focal length of said lens; and means for adjusting the relative positional relation between at least a part of said can member corresponding to said second magnification image formation mode and said first carriage corresponding to an error in the focal length of said lens with respect to said first direction.

23. The apparatus according to claim 22, wherein said correction means includes:

a stopper member for stopping said second lens carriage; and stopper position correction means for moving said stopper member over a distance corresponding to the error of the focal length of said lens during an image formation mode changing operation.

24. The apparatus according to claim 23, wherein said stopper position correction means includes:

a stopper member moving cam member for moving said stopper member in a direction along the movement path of said second lens carriage;

cam driving means for driving said stopper member moving cam member during an image formation mode change; and adjusting means for adjusting the mounted position relationship of said stopper member moving cam member to said cam driving means correspondingly to the error of the focal length of said lens.

25. The apparatus according to claim 23, wherein said correction means further includes:

stopper driving means for moving said stopper member into and out of the movement path of said second lens carriage during an image formation mode changing operation; and lens carriage position detecting means for detecting the position of said lens carriage and controlling said stopper member position changing means and said stopper driving means, said detecting means having a first portion moved over a distance corresponding to the error of the focal length of said lens by said stopper member position changing means, and a second portion fixed to said second lens carriage.

26. The apparatus according to claim 22, wherein said correction means has:

a stopper member for stopping said second lens carriage;

a first and a second engaging portion provided on said second lens carriage;

said stopper member being engaged with said first engaging portion during the first magnification image formation mode and being engaged with said second engaging portion during the second magnification image formation mode; and adjusting means for adjusting the spacing between said first and said second engaging portion correspondingly to the error of the focal length of said lens.

27. The appartatus according to claim 26, wherein said correction means further includes:

stopper driving means for moving said stopper member into and out of the movement path of said second lens carriage during an image formation mode changing operation; and lens carriage position detecting means for detecting the position of said second lens carriage and controlling said stopper driving means, said detecting means having a first portion provided in place, and a second and a third portion mounted on said second carriage with the spacing therebetween being adjustable correspondingly to the error of the focal length of said lens, said second portion corresponding to said first engaging portion and third portion corresponding to said second engaging portion.

28. The apparatus according to any one of claims 22 to 27, further including:

means for adjusting the fixed position of said lens relative to said first lens carriage correspondingly to the error of the focal length of said lens.

29. The apparatus according to any one of claims 22 to 27, wherein said first carriage guide cam member has a first cam surface corresponding to the first magnification image formation mode and a second cam surface corresponding to the second magnification image formation mode, said first cam surface and said second cam surface being straight and parallel to each other, and said adjusting means being provided for adjusting the relative positional relation between the whole of said cam member and said first carriage.

30. The apparatus according to claim 29, further including:

means for adjusting the fixed position of said lens relative to said first lens carriage correspondingly to the error of the focal length of said lens.

31. The apparatus according to any one of claims 22 to 27, wherein said first carriage guide cam member has a first cam surface corresponding to the first magnification image formation mode, a second cam surface corresponding to the second magnification image formation mode, said adjusting means being provided for adjusting the inclination of said second cam surface relative to said first cam surface.

32. The apparatus according to claim 31, further including:

means for adjusting the fixed position of said lens relative to said first lens carriage correspondingly to the error of the focal length of said lens.

33. The apparatus according to any one of claims 22 to 27, wherein said first direction is a direction perpendicular to the optical axis and said second direction is a direction parallel to the optical axis.

34. A variable magnification optical apparatus in which at least a first magnification image formation mode and a second magnification image formation mode can be selected, said apparatus including:

illuminating means for illuminating an original;

a photosensitive medium;

an optical system for forming an image of the original on said photosensitive medium, said optical system having a mirror and a lens;

a movable carriage for supporting said lens;

carriage moving means for moving said lens carriage to change the image formation mode; and correction means for correcting the distance over which said lens carriage is moved by said carriage moving means correspondingly to an error of the focal length of said lens, said correction means having a stopper member for stopping said lens carriage;

first and second engaging portion provided on said lens carriage; and adjusting means for adjusting the spacing between said first and said second engaging portion correspondingly to the error of the focal length of said lens, wherein said stopper member being engaged with said first engaging portion during the first magnification image formation mode and being engaged with said second engaging portion during the second magnification image formation mode.

35. A variable magnification optical apparatus in which at least a first magnification image formation mode and a second magnification image formation mode can be selected, said apparatus including:

illuminating means for illuminating an original;

a photosensitive medium;

an optical system for forming an image of the original on said photosensitive medium, said optical system having a mirror and a lens;

a movable carriage for supporting said mirror;

carriage moving means for moving said mirror carriage to change the image formation mode; and correction means for correcting the distance over which said mirror carriage is moved by said carriage moving means correspondingly to an error of the focal length of said lens, said correction means having a stopper member for stopping said mirror carriage, and stopper position correcting means for moving said stopper member over a distance corresponding to the error of the focal length of said lens during an image formation mode changing operation, said stopper position correcting means keeping the position of said stopper member at the same position relative to said first magnification image formation mode or to said second magnification image formation mode when the error of the focal length of said lens is zero.

36. A variable magnification optical apparatus in which at least a first magnification image formation mode and a second magnification image formation mode can be selected, said apparatus including:

illuminating means for illuminating an original;

a photosensitive medium;

an optical system for forming an image of the original on said photosensitive medium, said optical system having a mirror and a lens;

a movable carriage for supporting said mirror;

carriage moving means for moving said mirror carriage to change the image formation mode; and correction means for correcting the distance over which said mirror carriage is moved by said carriage moving means correspondingly to an error of the focal length of said lens, said correction means having a stopper member for stopping said mirror carriage;

first and second engaging portions provided on said mirror carriage; and adjusting means for adjusting the spacing between said first and said second engaging portion correspondingly to the error of the focal length of said lens, wherein said stopper member being engaged with said first engaging portion during the first magnification image formation mode and being engaged with said second engaging portion during the second magnification image formation mode.

37. A variable magnification optical apparatus in which at least a first magnification image formation mode and a second magnification image formation mode can be selected, said apparatus including:

illuminating means for illuminating an original;

a photosensitive medium;

an optical system for forming an image of the original on said photosensitive medium, said optical system having a mirror and a lens;

a movable carriage for supporting one of said mirror or lens;

carriage moving means for moving said carriage to change the image formation mode; and correction means for correcting the distance over which said carriage is moved by said carriage moving means correspondingly to an error of the focal length of said lens, said correction means having a stopper member for stopping said carriage;

a stopper engaging member mechanically connected to said carriage, said stopper engaging member having at least first and second engaging portions; and adjusting means for adjusting the spacing between said first and said second engaging portion correspondingly to the error of the focal length of said lens wherein said stopper member being engaged with said first engaging portion during the first magnification image formation mode and being engaged with said second engaging portion during the second magnification image formation mode.

* * * * *

UNITED STATES PATENT AND TRADEMARK OFFICE

CERTIFICATE OF CORRECTION

PATENT NO. : 4,497,573

DATED : February 5, 1985

INVENTOR(S) : MITSUHIRO TOKUHARA, ET AL.

It is certified that error appears in the above-identified patent and that said Letters Patent is hereby corrected as shown below:

Column 1, line 30, insert a period after "length".

Column 10, line 46, "modc" should read --mode--.

Column 20, line 49, "guids" should read --guides--.

Column 21, line 5, "60'C" should read --60'c--;
lines 7 and 8, "inclination)" should read --inclination--.

Column 31, line 66, "irror" should read --mirror--.

Column 33, line 29, "its" should read --it--.

Signed and Sealed this

*Twenty-fifth* Day of *March 1986*

[SEAL]

*Attest:*

*Attesting Officer*

DONALD J. QUIGG

*Commissioner of Patents and Trademarks*